US012653268B2

(12) United States Patent
Andrews et al.

(10) Patent No.: US 12,653,268 B2
(45) Date of Patent: Jun. 16, 2026

(54) SOLE STRUCTURE FOR ARTICLE OF FOOTWEAR

(71) Applicant: NIKE, Inc., Beaverton, OR (US)

(72) Inventors: Teagen E. Andrews, Portland, OR (US); Leo S. Chang, Portland, OR (US); Jeremy L. Connell, Portland, OR (US); Karen S. Dimoff, Portland, OR (US); Emily M. Farina, North Plains, OR (US); Rachel M. Savage, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/660,780

(22) Filed: May 10, 2024

(65) Prior Publication Data

US 2024/0373980 A1 Nov. 14, 2024

Related U.S. Application Data

(60) Provisional application No. 63/625,612, filed on Jan. 26, 2024, provisional application No. 63/501,932, filed on May 12, 2023.

(51) Int. Cl.
*A43B 13/18* (2006.01)
*A43B 13/14* (2006.01)

(52) U.S. Cl.
CPC ..... *A43B 13/187* (2013.01); *A43B 13/143* (2013.01)

(58) Field of Classification Search
None
See application file for complete search history.

(56) References Cited

U.S. PATENT DOCUMENTS

| | | | | |
|---|---|---|---|---|
| 5,528,842 | A * | 6/1996 | Ricci | A43B 21/30 36/38 |
| 6,675,499 | B2 * | 1/2004 | Ellis, III | A43B 13/143 36/25 R |
| 6,729,046 | B2 * | 5/2004 | Ellis, III | A43B 13/148 36/31 |
| 7,814,683 | B2 * | 10/2010 | Lee | A43B 21/30 36/28 |
| 9,936,765 | B2 * | 4/2018 | Sato | A43B 13/186 |
| 10,849,387 | B2 * | 12/2020 | Bruce | A43B 7/1445 |

(Continued)

FOREIGN PATENT DOCUMENTS

| | | |
|---|---|---|
| EM | EU-3355738 B1 | 8/2020 |
| WO | WO-2022147035 A1 | 7/2022 |

OTHER PUBLICATIONS

European Patent Office (ISA), International Search Report and Written Opinion for PCT App. No. PCT/US2024/029013, mailed Sep. 3, 2024.

*Primary Examiner* — Jila M Mohandesi
(74) *Attorney, Agent, or Firm* — Honigman LLP; Matthew H. Szalach; Jonathan P. O'Brien

(57) ABSTRACT

A plate for a sole structure of an article of footwear includes a platform extending from a first platform end to a second platform end, the platform being substantially planar from the first platform end to the second platform end, a first arcuate segment extending in a first direction from the first platform end to a first distal end, and a second arcuate segment extending in an opposite second direction from the second platform end to a second distal end, the second distal end being coplanar with the first distal end.

19 Claims, 25 Drawing Sheets

(56) References Cited

U.S. PATENT DOCUMENTS

| | | | | |
|---|---|---|---|---|
| 11,712,395 | B2 * | 8/2023 | Behnamian | A61H 15/00 36/25 R |
| 2004/0205983 | A1 * | 10/2004 | Talbott | A43B 13/146 36/102 |
| 2007/0294915 | A1 * | 12/2007 | Ryu | A43B 13/183 36/28 |
| 2010/0263228 | A1 * | 10/2010 | Kang | A43B 13/20 36/29 |
| 2012/0297641 | A1 * | 11/2012 | Pfister | B29D 35/142 36/43 |
| 2013/0125421 | A1 * | 5/2013 | Stegmaier | A43B 13/141 36/102 |
| 2020/0205514 | A1 * | 7/2020 | VanDomelen | A43B 13/188 |
| 2020/0281312 | A1 * | 9/2020 | Connell | A43B 13/127 |
| 2022/0022597 | A1 | 1/2022 | Bowman et al. | |
| 2023/0144343 | A1 | 5/2023 | Dunning | |
| 2023/0414446 | A1 * | 12/2023 | Behnamian | A61H 15/00 |

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application No. 63/625,612, filed on Jan. 26, 2024, and to U.S. Provisional Application No. 63/501,932, filed on May 12, 2023. The disclosures of these prior applications are considered part of the disclosure of this application and are hereby incorporated by reference in their entirety.

FIELD

The present disclosure relates generally to an article of footwear and, more particularly, to a sole structure for an article of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

The metatarsophalangeal (MTP) joint of the foot is known to absorb energy as it flexes through dorsiflexion during running movements. As the foot does not move through plantarflexion until the foot is pushing off of a ground surface, the MTP joint returns little of the energy it absorbs to the running movement and, thus, is known to be the source of an energy drain during running movements. Embedding flat and rigid plates having longitudinal stiffness within a sole structure is known to increase the overall stiffness thereof. While the use of flat plates stiffens the sole structure for reducing energy loss at the MTP joint by preventing the MTP joint from absorbing energy through dorsiflexion, the use of flat plates also adversely increases a mechanical demand on ankle plantarflexors of the foot, thereby reducing the efficiency of the foot during running movements, especially over longer distances.

DRAWINGS

The drawings described herein are for illustrative purposes only of selected configurations and are not intended to limit the scope of the present disclosure.

Figure 7:
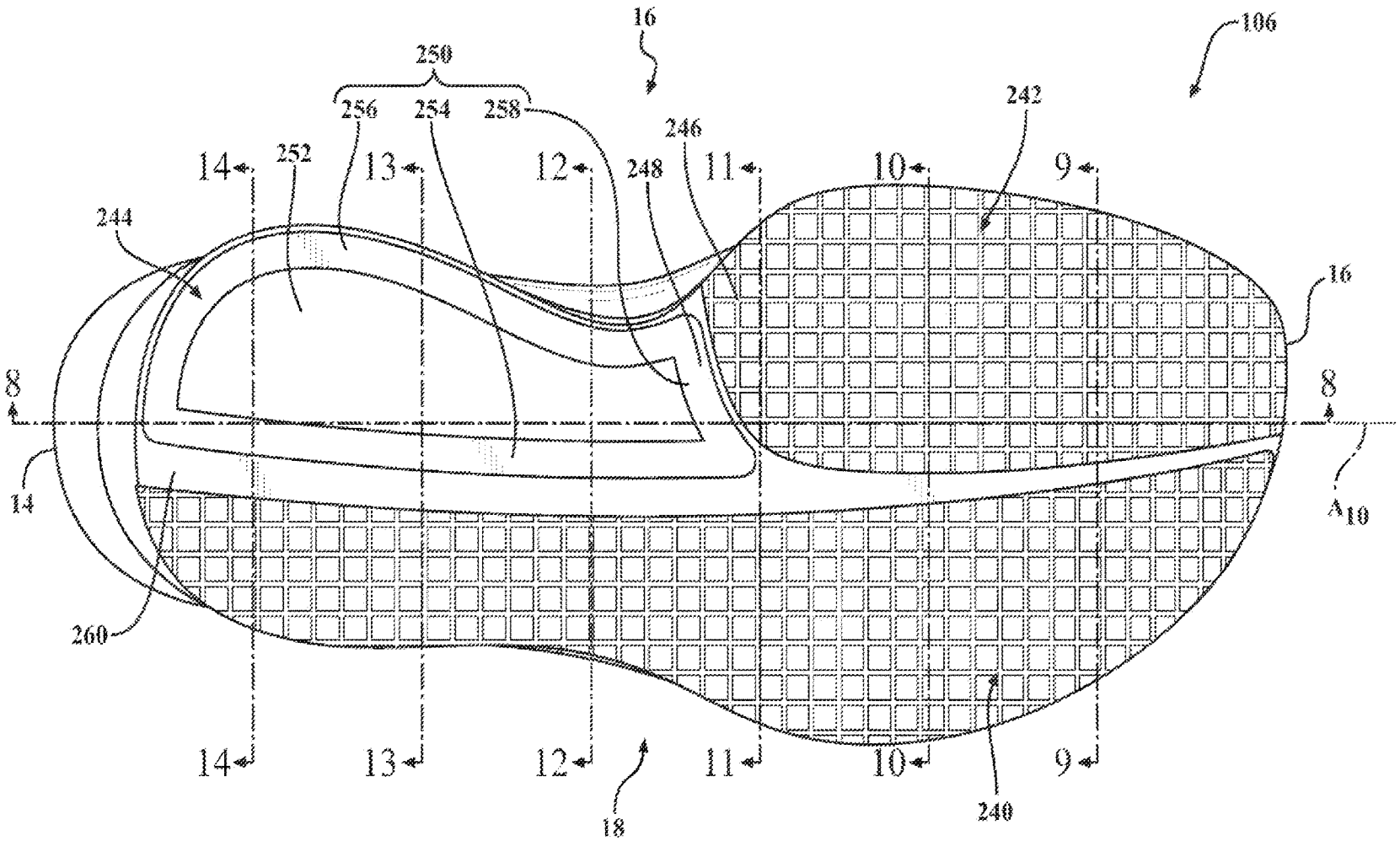
FIG. 7 is a bottom plan view of the sole structure of FIG. 1.
Figure 17:
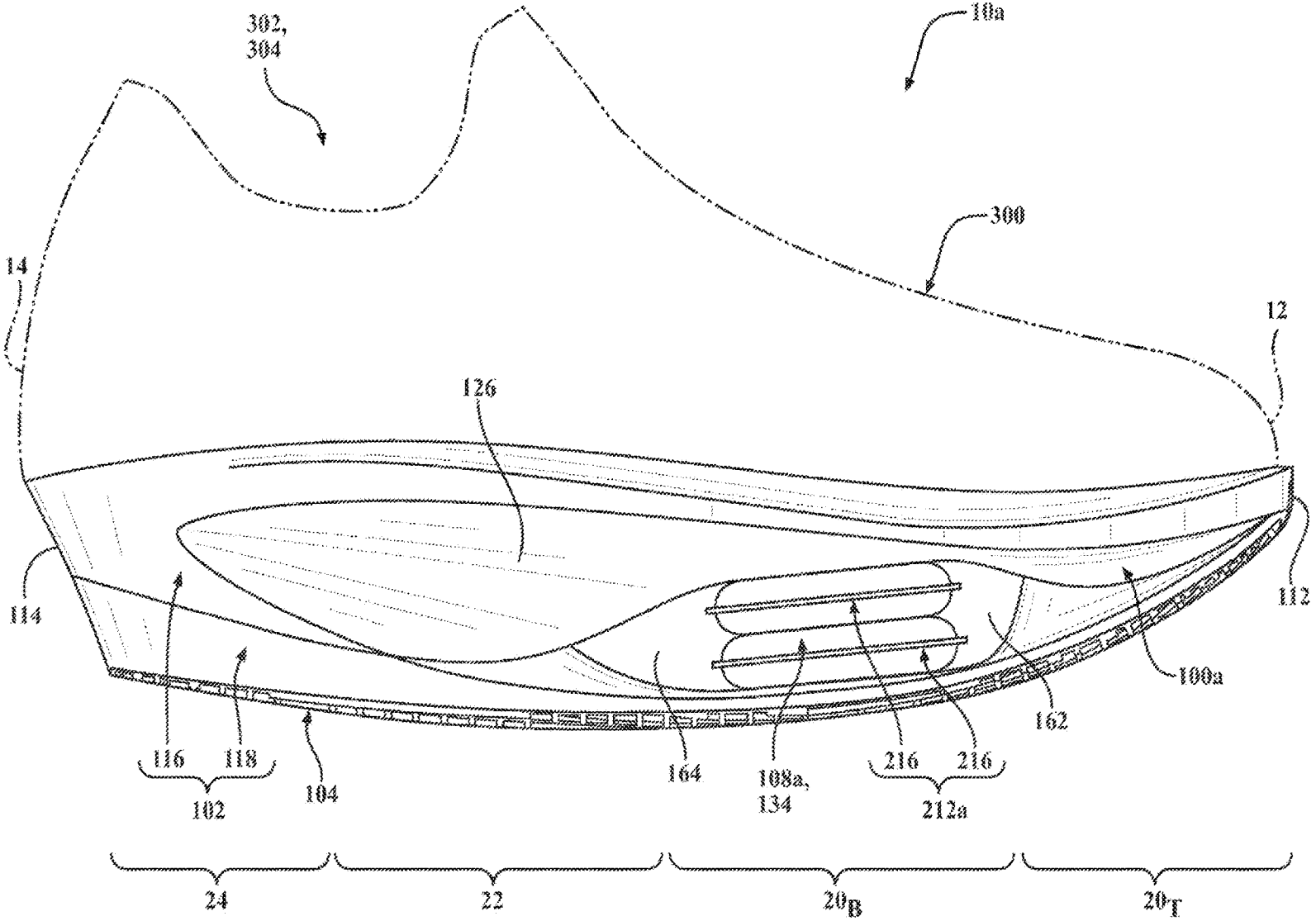
FIG. 17 is a lateral side view of a sole structure for an article of footwear according to another example of the present disclosure.
Figure 18:
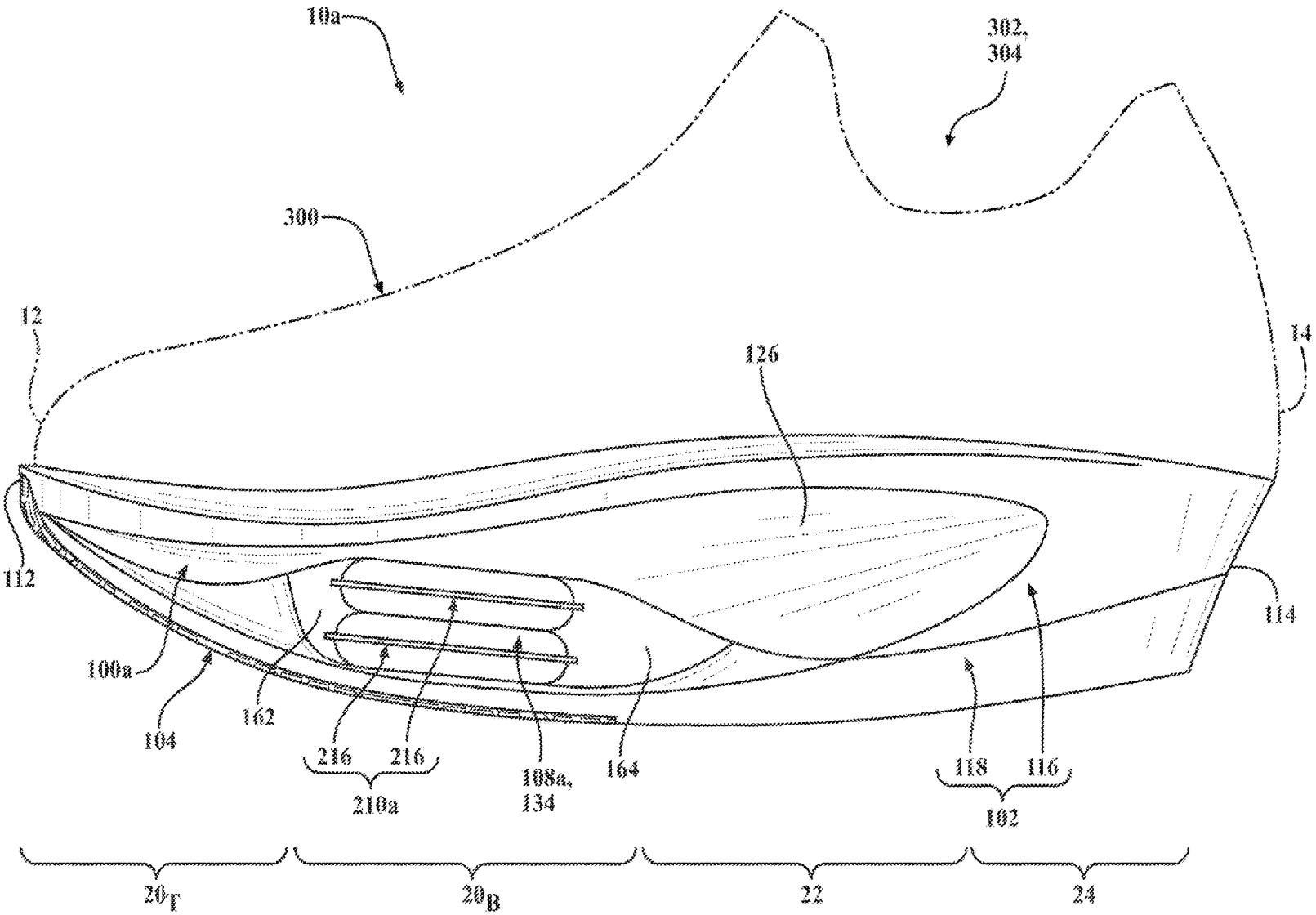
FIG. 18 is a medial side view of the sole structure of FIG. 17.
Figure 19:
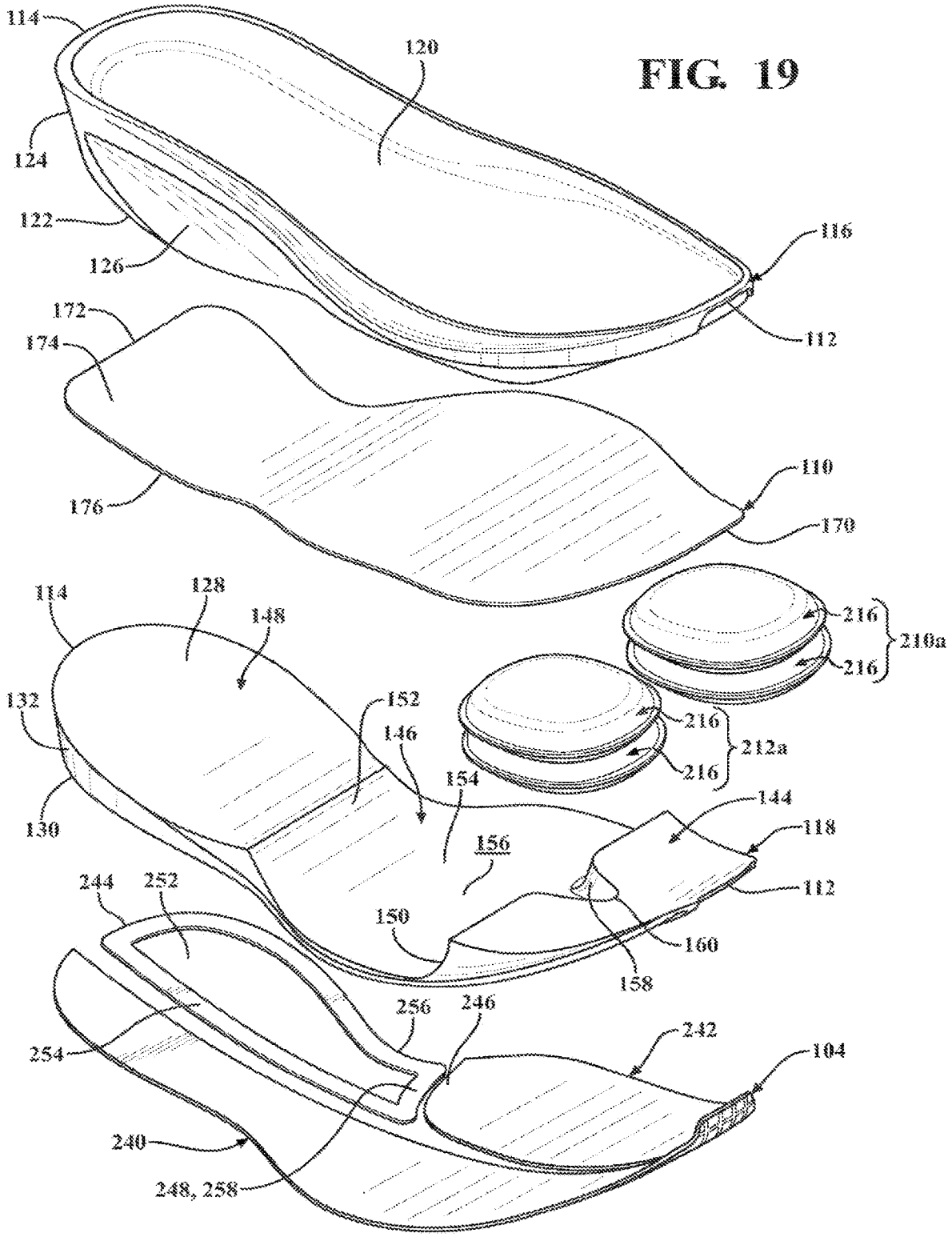
FIG. 19 is an exploded top perspective view of the sole structure of FIG. 17.
Figure 20:
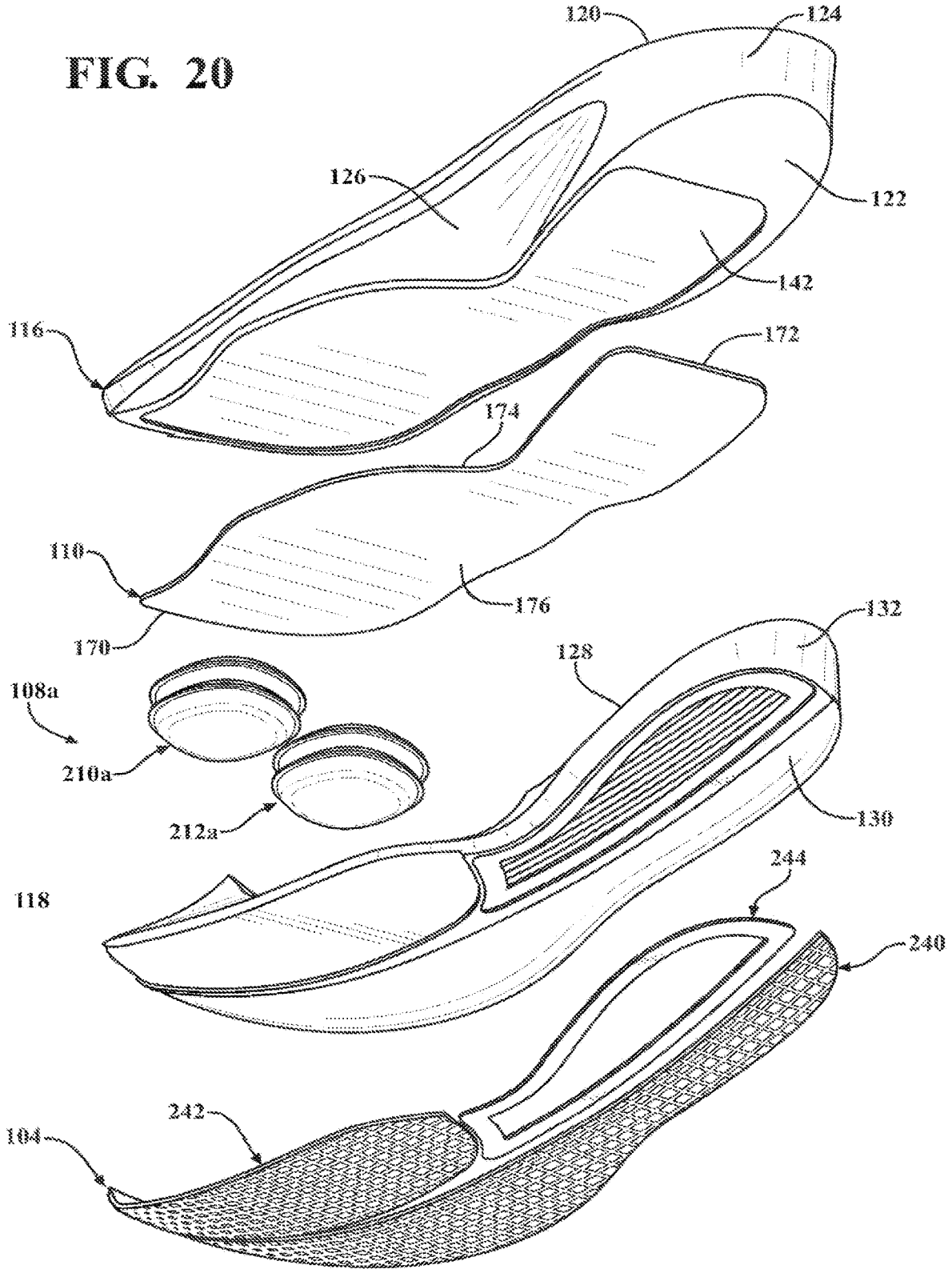
FIG. 20 is an exploded bottom perspective view of the sole structure of FIG. 17.
Figure 21A:
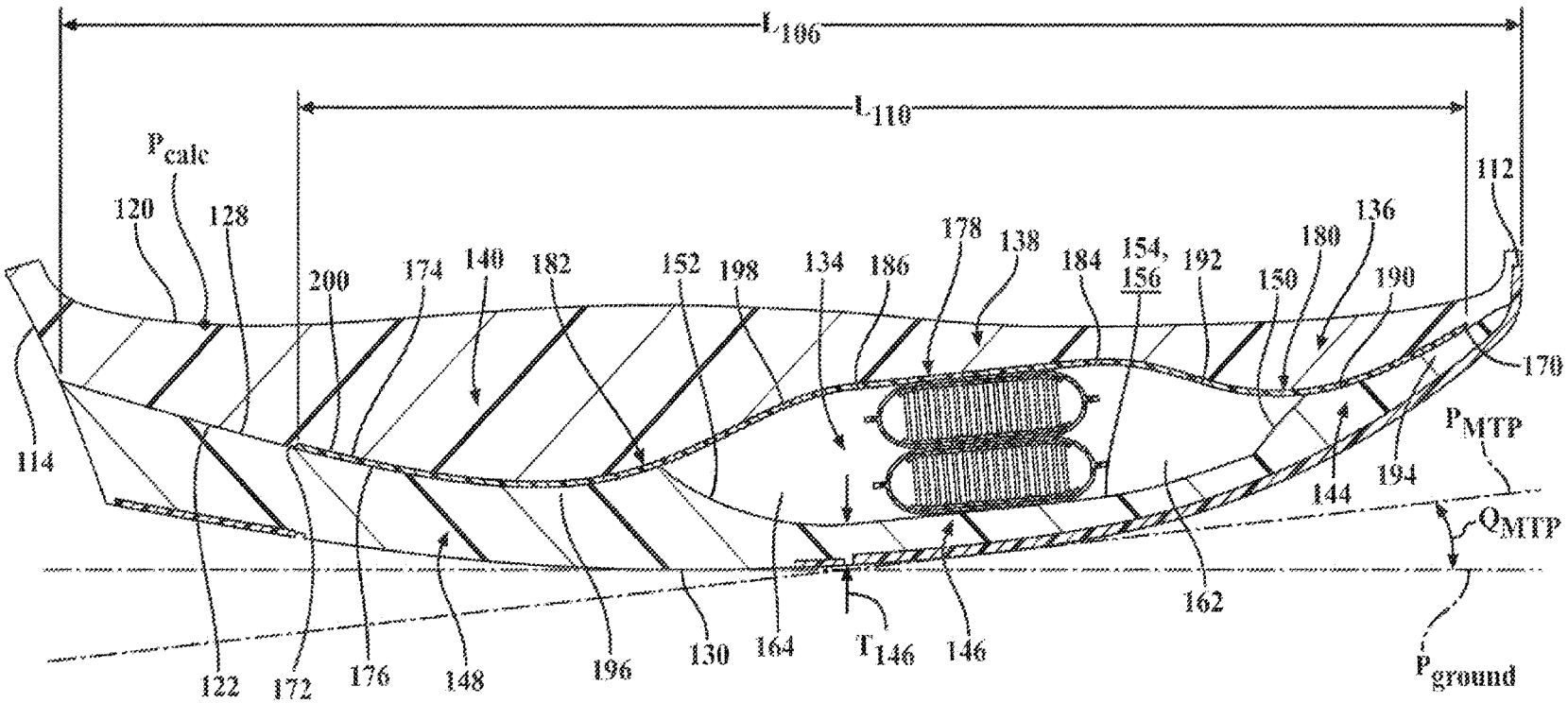
FIG. 21A is a cross-sectional view of the sole structure of FIG. 17, taken along a longitudinal axis of the sole structure of FIG. 17 in a similar location as Line 8-8 of FIG. 7.
Figure 21B:
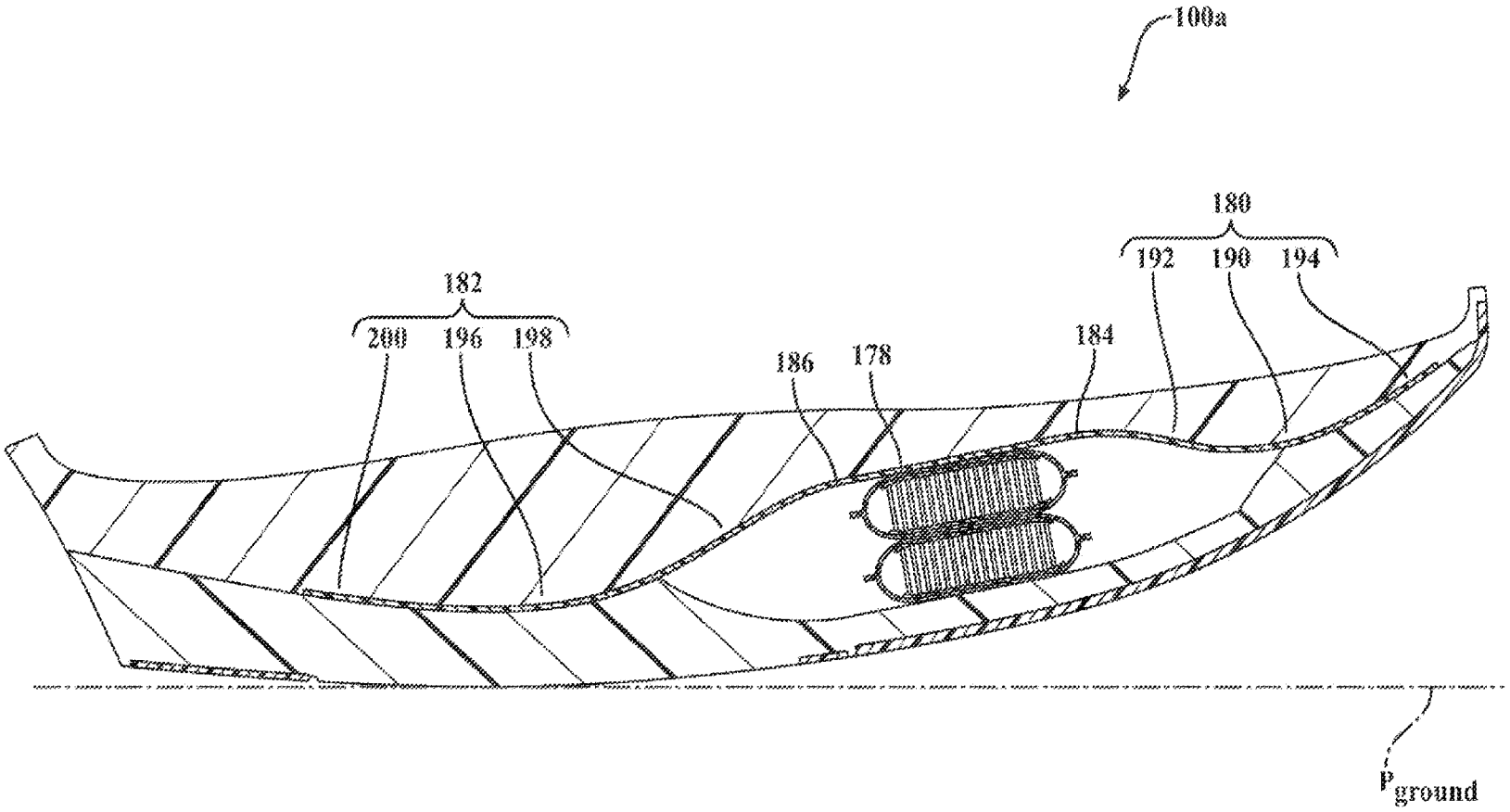
FIG. 21B is a cross-sectional view of the sole structure of FIG. 17, taken along a longitudinal axis of the sole structure of FIG. 17 in a similar location as Line 8-8 of FIG. 7 and showing the sole structure in an initial contact phase of a gait cycle.
Figure 21C:
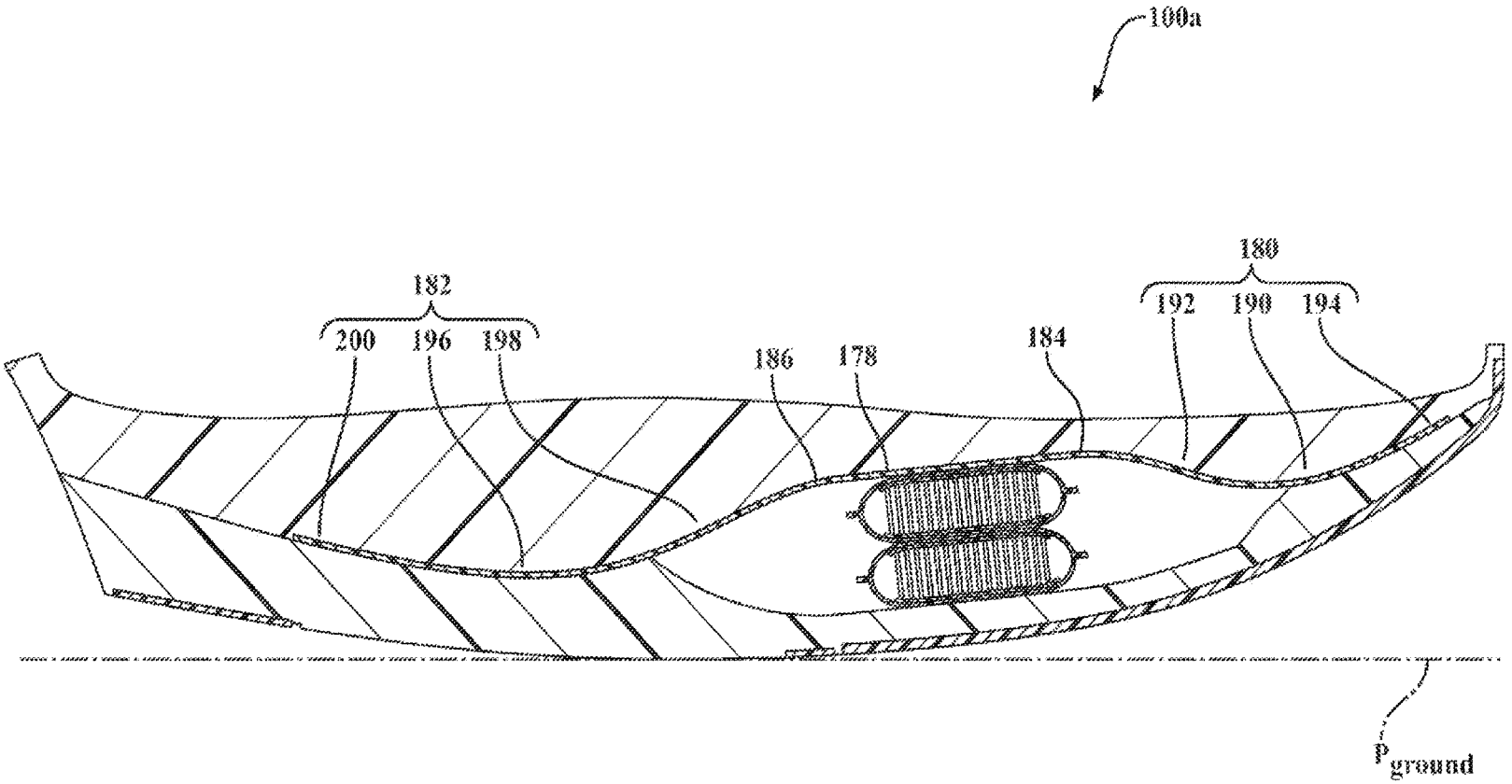
FIG. 21C is a cross-sectional view of the sole structure of FIG. 17, taken along a longitudinal axis of the sole structure of FIG. 17 in a similar location as Line 8-8 of FIG. 7 and showing the sole structure in a loading response phase of a gait cycle.
Figure 21D:
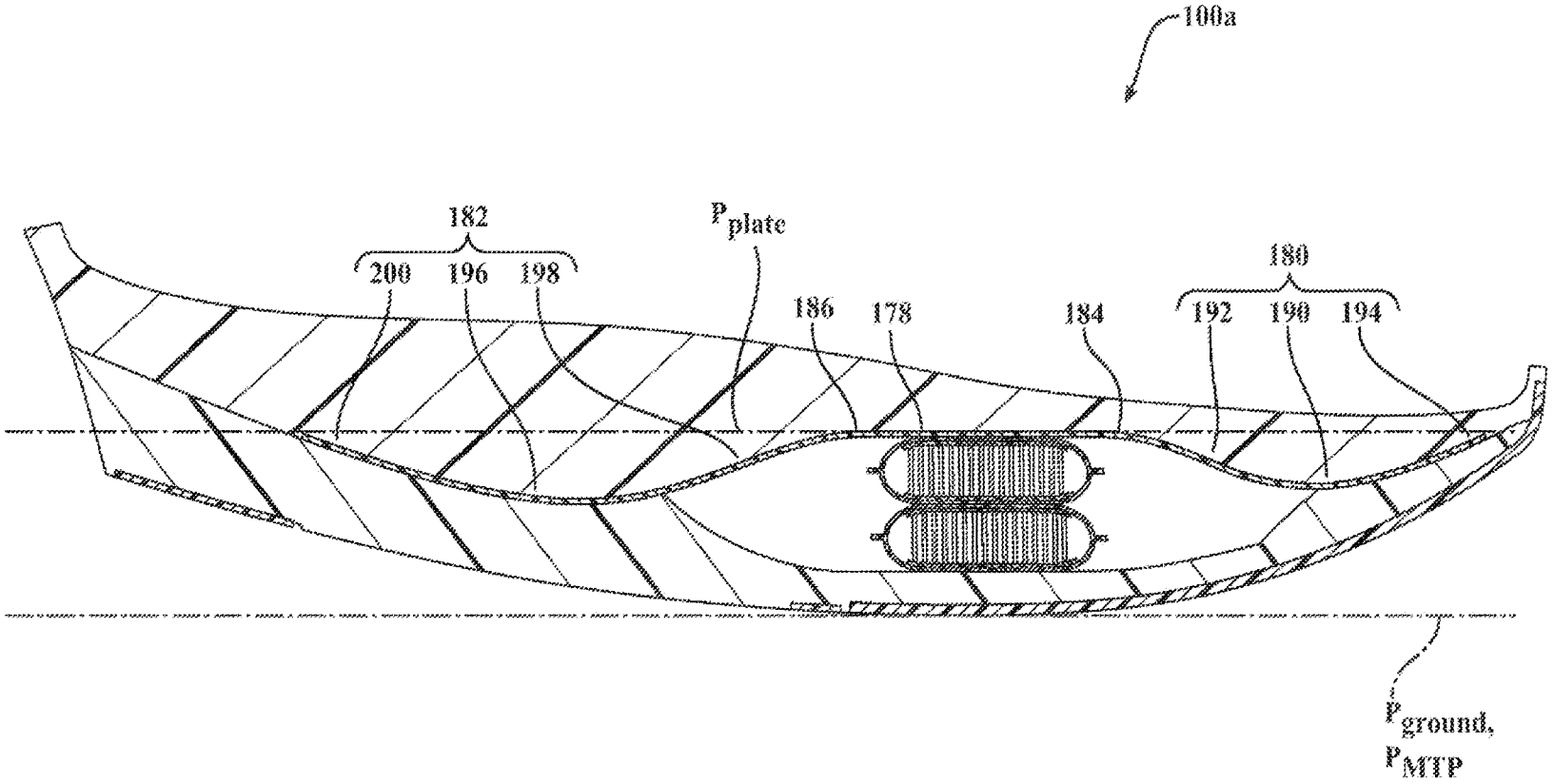
Figure 21E:
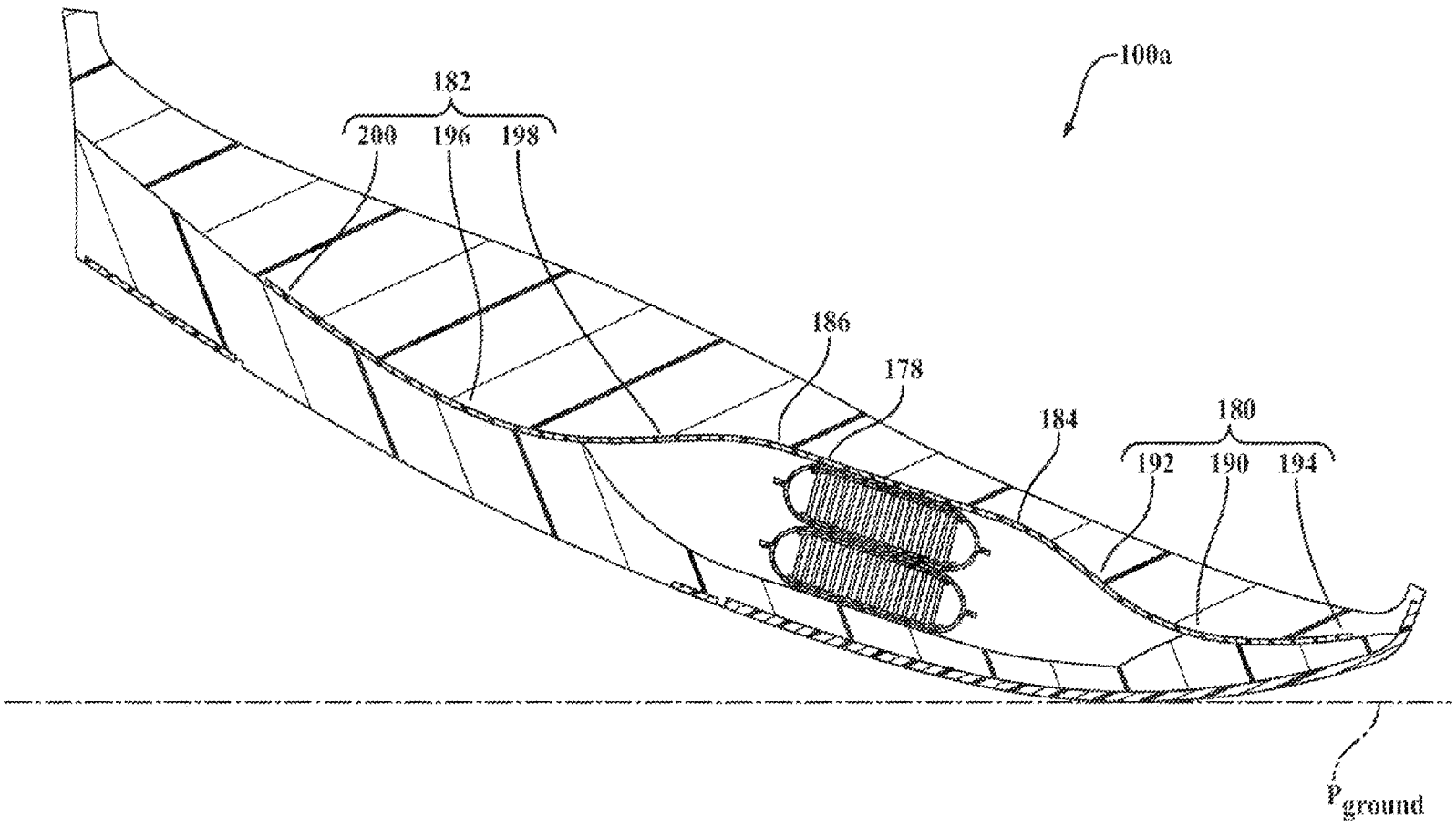

FIG. 21D is a cross-sectional view of the sole structure of FIG. 17, taken along a longitudinal axis of the sole structure of FIG. 17 in a similar location as Line 8-8 of FIG. 7 and showing the sole structure in a terminal stance phase of a gait cycle; and FIG. 21E is a cross-sectional view of the sole structure of FIG. 17, taken along a longitudinal axis of the sole structure of FIG. 17 in a similar location as Line 8-8 of FIG. 7 and showing the sole structure in a push-off phase of a gait cycle.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Referring to FIGS. 1-16, an article of footwear 10 includes a sole structure 100 and an upper 300 attached to the sole structure 100. The footwear 10 may further include an anterior end 12 associated with a forward-most point of the footwear 10, and a posterior end 14 corresponding to a rearward-most point of the footwear 10. As shown in FIG. 7, a longitudinal axis $A_{10}$ of the footwear 10 extends along a length of the footwear 10 from the anterior end 12 to the posterior end 14 parallel to a ground surface, and generally divides the footwear 10 into a medial side 16 and a lateral side 18. Accordingly, the medial side 16 and the lateral side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the medial side 16 to the lateral side 18.

Figure 8A:
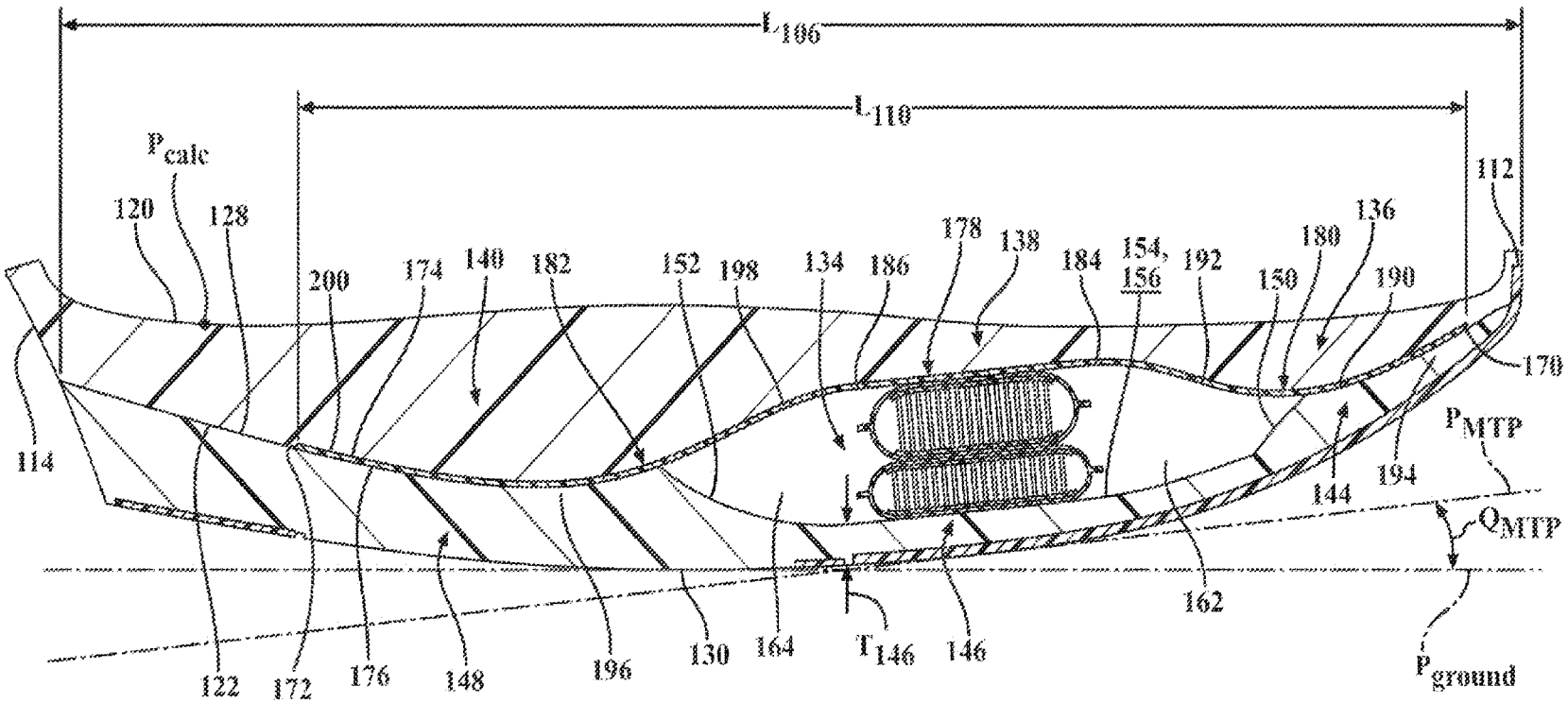
FIG. 8A is a cross-sectional view of the sole structure of FIG. 1, taken along Line 8-8 in FIG. 7.

The article of footwear 10 may be divided into one or more regions. The regions may include a forefoot region 20, a midfoot region 22, and a heel region 24. The forefoot region 20 may be subdivided into a toe portion $\mathbf{20}_T$ corresponding with phalanges and a ball portion $\mathbf{20}_B$ associated with metatarsal bones of a foot. Thus, reference to the forefoot region 20 throughout the description collectively refers to the region including the toe portion $\mathbf{20}_T$ and the ball portion $\mathbf{20}_B$. The midfoot region 22 may correspond with an arch area of the foot, and the heel region 24 may correspond with rear portions of the foot, including a calcaneus bone. As shown in FIG. 8A, features of the article of footwear 10 may be defined relative to a ground reference plane $Pl_{ground}$, which is defined as a horizontal plane that extends tangent to the ground-engaging surface 101 of the sole structure 100 when the sole structure 100 is configured in an unloaded or resting state. Alternatively, features may be defined relative to a footbed plane $Pl_{footbed}$, which is a reference plane that extends through (i) an MTP point on the footbed corresponding to the MTP joint of the foot and (ii) a calcaneus point $Pt_{calc}$ on the footbed corresponding to the calcaneus bone of the foot when the footwear 10 is donned by a user.

The sole structure 100 includes a midsole 102 configured to provide cushioning and support and an outsole 104 defining a ground-engaging surface 101 (i.e., contacts the ground during a stance phase of a gait cycle) of the sole structure 100. Unlike conventional sole structures, which include monolithic midsoles and outsoles, the sole structure 100 of the present disclosure is configured as a composite structure including a plurality of components joined together. For example, the midsole 102 includes a resilient cushion or cushioning element 106, a cushioning arrangement 108, and a plate 110. The outsole 104 is attached to the midsole 102 to provide traction and abrasion resistance.

Figure 1:
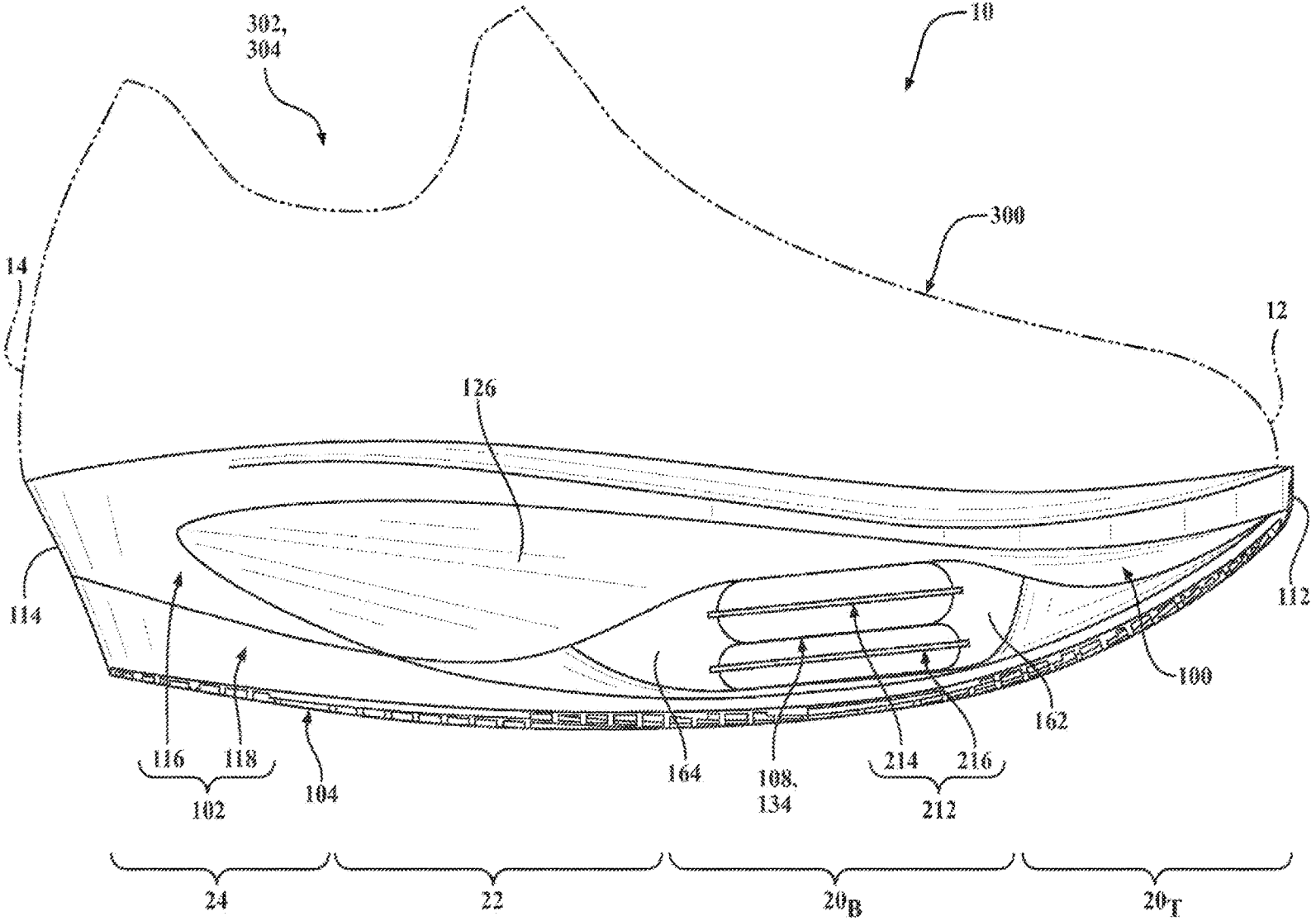
FIG. 1 is a lateral side view of a sole structure for an article of footwear according to an example of the present disclosure.
Figure 2:
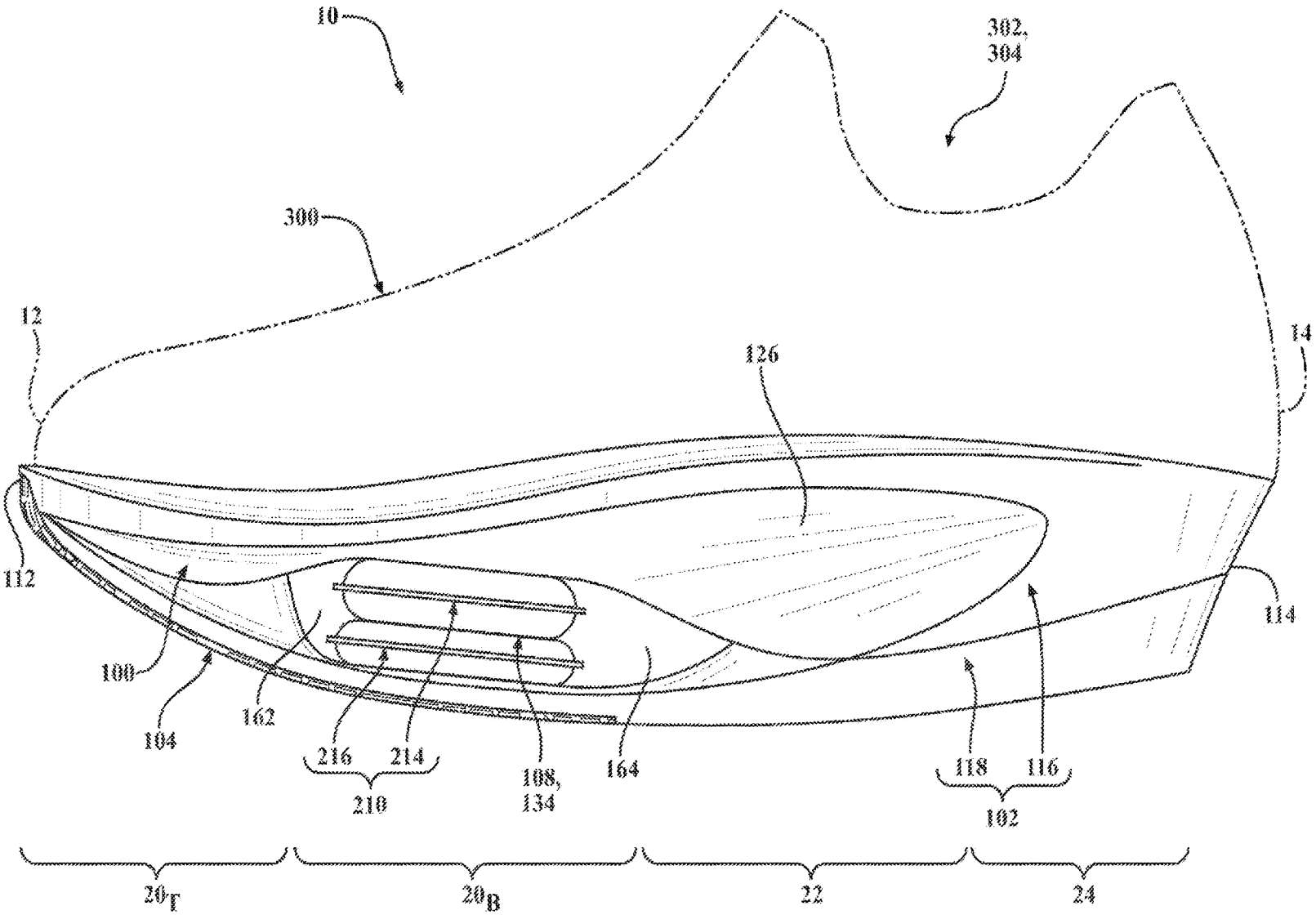
FIG. 2 is a medial side view of the sole structure of FIG. 1.

With reference to FIGS. 1 and 2, the cushioning element 106 of the midsole 102 extends from a first end 112 at the anterior end 12 of the footwear 10 to a second end 114 at the posterior end 14 of the footwear 10. While the cushioning element 106 may be formed as a monolithic structure including a homogenous elastomeric material, the cushioning element 106 of the present example is defined in terms of a plurality of portions or subcomponents. For example, the cushioning element 106 includes an upper cushion or cushioning member 116 disposed adjacent to the upper 300 and a lower cushion or cushioning member 118 disposed adjacent to the outsole 104.

Each of the upper cushioning member 116 and the lower cushioning member 118 extends continuously from the first end 112 of the cushioning element 106 to the second end 114 of the cushioning element 106. The upper cushioning member 116 includes a top side 120 facing the upper 300 and defining a profile of a footbed of the sole structure 100, a lower side 122 formed on an opposite side of the cushioning element 106 from the top side 120 and, and a peripheral side 124 extending from the top side 120 to the lower side 122 and defining an outer peripheral profile of the upper cushioning member 116. The peripheral side 124 may include side reliefs 126 formed on each of the medial side 16 and the lateral side 18 of the cushioning element 106. As shown, the side reliefs 126 include elongate recesses having a concave cross-sectional profile extending along each side of the cushioning element 106 in the midfoot region 22 and the heel region 24. The side reliefs 126 may have an ellipsoidal profile, whereby a depth (i.e., measured inwardly from the peripheral side 124) is greatest at a central portion of the side relief 126 and tapers or decreases in a direction towards the edges or boundary of the side relief 126.

Likewise, the lower cushioning member 118 includes an upper side 128 that faces the lower side 122 of the upper cushioning member 116, a bottom side 130 formed on an opposite side from the upper side 128 and defining a profile of a ground-engaging surface 101 of the sole structure 100, and a peripheral side 132 extending from the upper side 128 to the bottom side 130 and defining an outer peripheral profile of the lower cushioning member 116.

As described in greater detail below, the cushioning element 106 includes a receptacle 134 formed within the cushioning element 106 between the top side 120 and the bottom side 130 in the forefoot region 20 and the midfoot region 22. As best shown in FIGS. 1 and 2, the receptacle 134 is configured to receive and support the cushioning arrangement 108 within the cushioning element 106. In other words, the cushioning element 106 extends above the cushioning arrangement 108 (i.e., between the cushioning arrangement 108 and the upper 300) and beneath the cushioning arrangement 108 (i.e., between the cushioning arrangement 108 and the outsole 104). In the illustrated example, the receptacle 134 is defined between the lower side 122 of the upper cushioning member 116 and the upper side 128 of the lower cushioning member 118.

Referring now to FIGS. 3-9, the upper cushioning member 116 extends continuously from the first end 112 of the cushioning element 106 to the second end 114 of the cushioning element 106. The lower side 122 of the upper cushioning member 116 is generally configured to mate or interface with a top side of the plate 110, as discussed more below. Thus, the upper cushioning member 116 may be described as including a forefoot section 136, a midfoot section 138, and a heel section 140. The sections 136, 138, 140 of the upper cushioning member 116 are associated with geometries of the lower side 122 that correspond to the geometries of the plate 110. For example, the lower side 122 defines generally convex surfaces extending through the forefoot section 136 and the heel section 140, while the portion of the lower side 122 disposed between the forefoot section 136 and the heel section 140 is recessed towards the top side 120 (i.e. a thickness of the upper cushioning member 116 is reduced) relative to the forefoot section 136 and the heel section 140.

Figure 4:
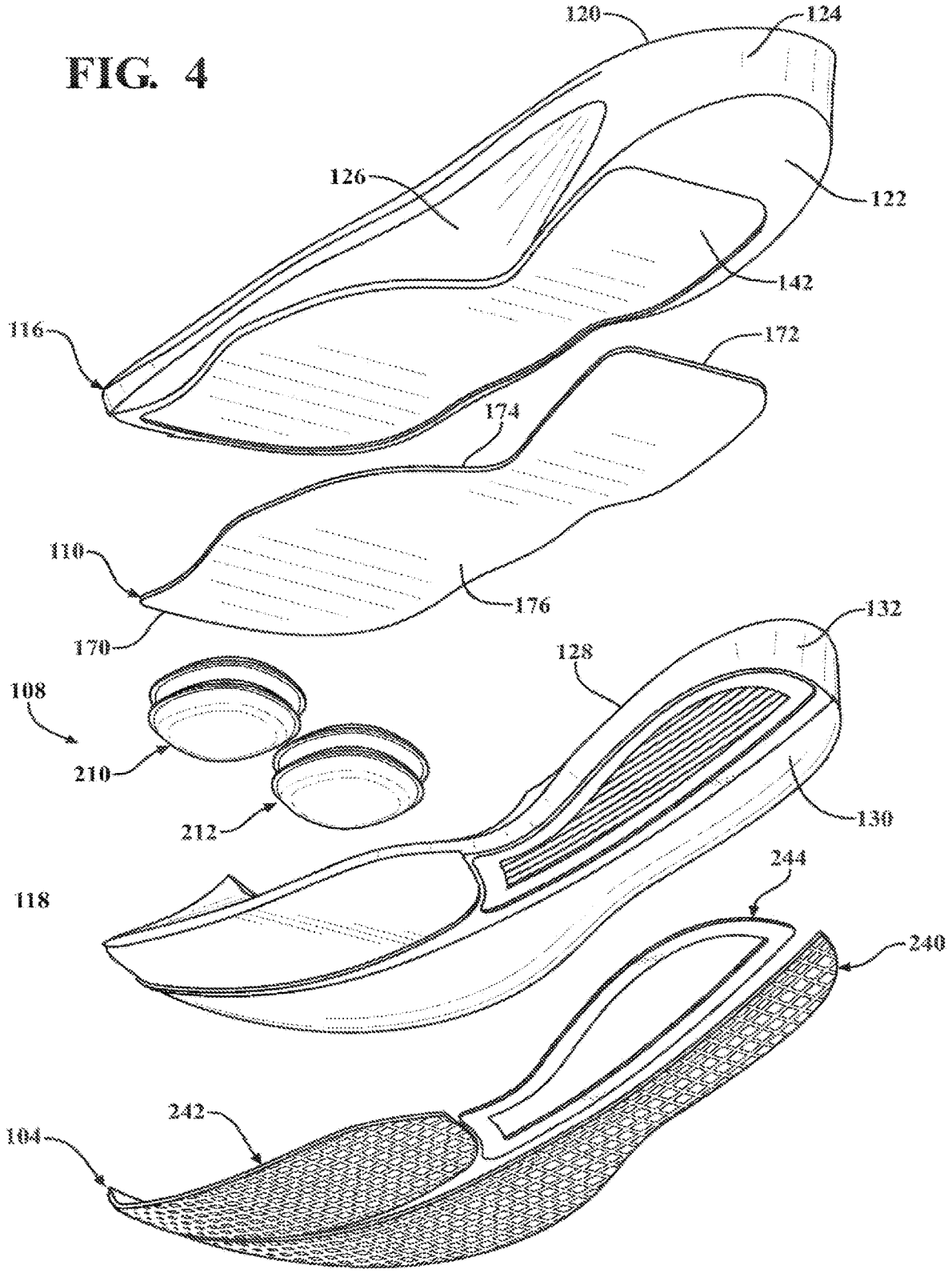
FIG. 4 is an exploded bottom perspective view of the sole structure of FIG. 1.
Figure 5:
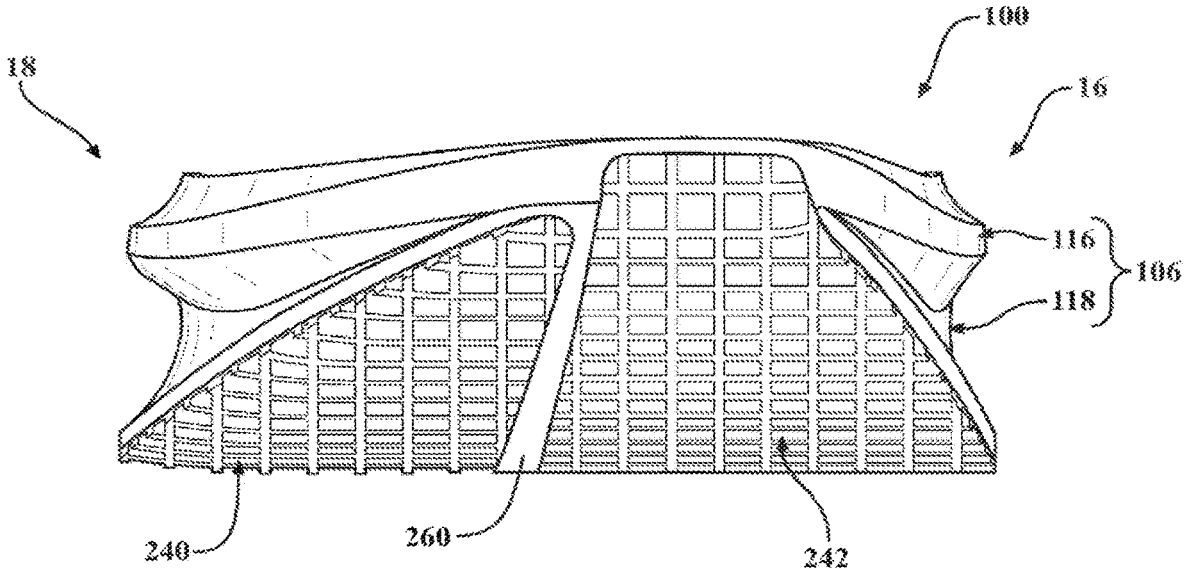
FIG. 5 is a front elevation view of the sole structure of FIG. 1.
Figure 6:
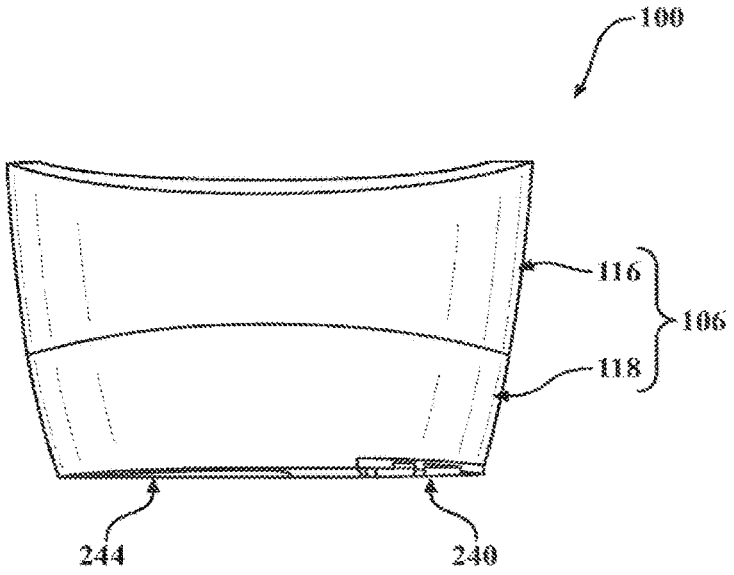
FIG. 6 is a rear elevation view of the sole structure of FIG. 1.

The midfoot section 138 includes a substantially planar portion of the lower side 122 and defines an upper portion of the receptacle 134 for receiving the cushioning arrangement 108 between the upper cushioning member 116 and the lower cushioning member 118. As shown in FIG. 8A, the planar portion defined by the midfoot section 138 is oriented at an oblique angle relative to the footbed plane $Pl_{footbed}$ defined by the sole structure 100. As discussed in greater detail below, the angle $\theta_{plate}$ of the midfoot section 138 corresponds to a relative angle between a reference plane $Pl_{plate}$ of the plate 110 (FIG. 15), which is oriented to be parallel with an MTP reference plane $Pl_{MTP}$ that extends parallel to the ground-engaging surface 101 of the sole structure 100 at the MTP joint, and the footbed plane $Pl_{footbed}$. Thus, FIG. 8A shows an angle $\theta_{MTP}$ between the MTP reference plane $Pl_{MTP}$ and the ground reference plane $Pl_{ground}$ that is the same as the relative angle $\theta_{plate}$ of orientation between the footbed plane $Pl_{footbed}$ and each of the midfoot section 138 and the plate reference plane $Pl_{plate}$. As shown in FIG. 4, the lower side 122 of the upper cushioning member 116 includes an upper plate pocket 142 configured to receive an upper portion of the plate 110 when the sole structure 100 is assembled.

Referring still to FIGS. 3-9, the lower cushioning member 118 extends continuously from the first end 112 of the cushioning element 106 to the second end 114 of the cushioning element 106 and includes the upper side 128 and the bottom side 130, as described previously. When the sole structure 100 is assembled, the upper side 128 of the lower cushioning member 118 faces and is attached to the lower side 124 of the upper cushioning member 116 to form the cushioning element 106. As with the upper cushioning member 116, the lower cushioning member 118 includes a forefoot section 144, a midfoot section 146, and a heel section 148. Generally, the forefoot section 144 and the heel section 148 of the lower cushioning member 118 form anterior and posterior support segments of the lower cushioning member 118, which are configured to interface or mate with a bottom side of the plate 110, while a portion of the upper side 128 defined by the midfoot section 146 is configured to be spaced apart from the bottom side of the plate 110 to define the receptacle 134 for receiving the cushioning arrangement 108. Thus, the midfoot section 146 may be referred to as forming a tray having a reduced thickness $T_{146}$ relative to the forefoot section 144 and the heel section 148.

With particular reference to FIG. 8A, the midfoot section 146 of the lower cushioning member 118 extends from a first end 150 adjacent to the toe portion $\mathbf{20}_T$ to a second end 151 in the midfoot region 22. An intermediate portion 154 of the midfoot section 146 extends between and connects the first end 150 and the second end 151. The first end 150 is defined by front surface 152 that extends from the upper side 128 of the forefoot section 144 at an oblique angle relative to the ground plane $Pl_{ground}$ when the sole structure 100 is in the resting state, as illustrated in FIG. 8A. The second end 151 is defined by a rear surface 153 that extends from the upper side 128 of the heel section 148 to the intermediate portion 154. As shown, the rear surface 153 includes a concave profile and is tangent with the intermediate portion 154. Thus, bending forces applied along the midfoot region 22 may be evenly distributed between the second end 151 and the intermediate portion 154 to minimize localization of stresses in the midfoot region 22.

Figure 10:
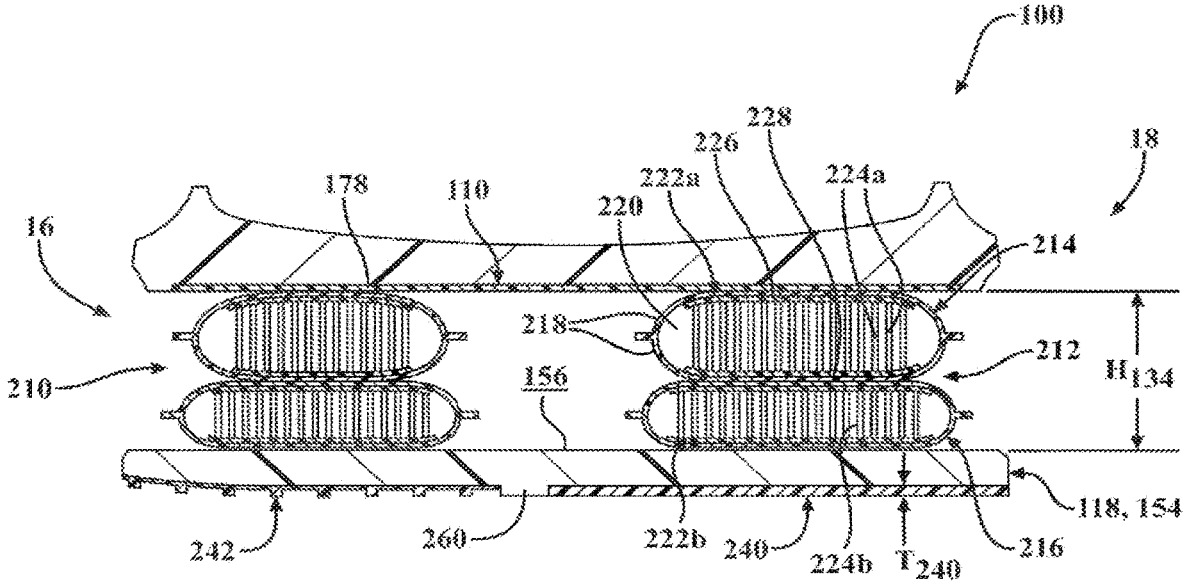
FIG. 10 is a cross-sectional view of the sole structure of FIG. 1, taken along Line 10-10 in FIG. 7.

The recessed support surface 156 is spaced apart from the bottom of the plate 110 by a distance defining a height $H_{134}$ of the receptacle 134 and is substantially parallel to the planar portion of the midfoot section 138 of the upper cushioning member 116. As shown in FIG. 10, the height $H_{134}$ of the receptacle 134 corresponds to a thickness $T_{108}$ of the cushioning arrangement 108 such that the cushioning arrangement 108 contacts a bottom side of the plate 110 when the sole structure 100 is assembled. Thus, a central axis $A_{108}$ defined by the cushioning arrangement 108 is oriented perpendicular to the plate 110 and the recessed support surface 156. In other words, the central axis $A_{108}$ of the cushioning arrangement is also oriented at an oblique angle relative to the footbed plane $Pl_{footbed}$. In the illustrated example, each of the surfaces 152, 153, 156 extends continuously through an entire width of the midsole 102 from the medial side 16 to the lateral side 18 such that the receptacle 134 effectively forms a channel extending across the width of the sole structure 100. As shown, the cushioning arrangement 108 is displayed and unconstricted along the sides 16, 18 when the sole structure 100 is assembled.

The recessed portion of the upper side 128 defined by the intermediate portion 154 of the midfoot section 146 includes a substantially planar support surface 156 for supporting and attaching to the cushioning arrangement 108. While not shown in the illustrated example, the intermediate portion 154 may include one or more bladder retainers, such as annular ribs or recesses configured to mate with a lower portion of the cushioning arrangement 108. However, the illustrated example is formed without retainers, whereby the interface between the cushioning arrangement 108 and the planar surface permits maximum deflection or expansion of the cushioning arrangement 108 when compressed.

Figure 3:
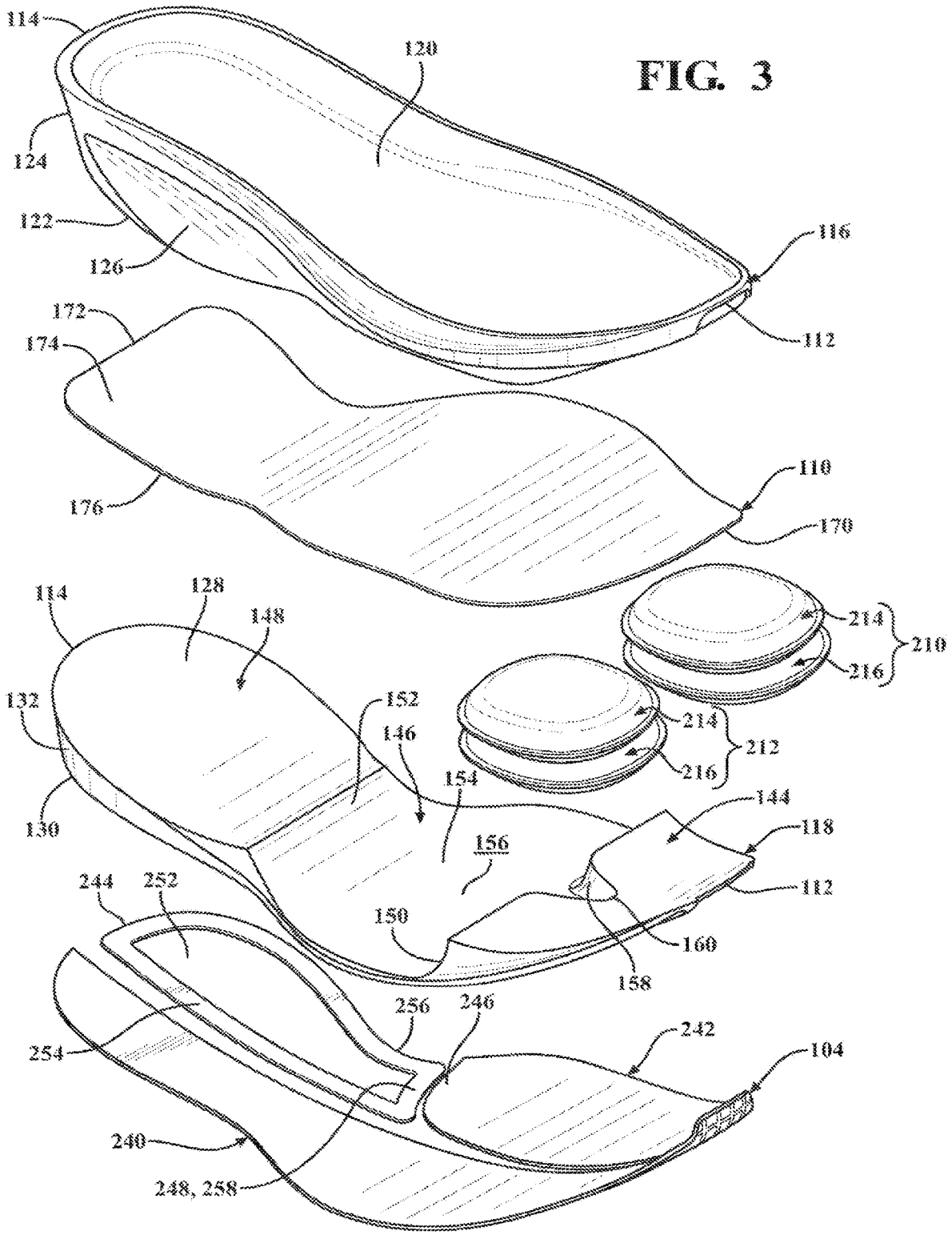
FIG. 3 is an exploded top perspective view of the sole structure of FIG. 1.

Referring to FIG. 3, the anterior support segment or forefoot section 144 of the lower cushioning member 118 may include a notch or relief 158 extending towards the anterior end 12 from the front surface 150 of the midfoot section 146 (i.e., the rear surface of the forefoot section 144) to an apex 160 disposed between the front surface 152 and the first end 112 of the cushioning element 106. As shown, the relief 158 is generally centered along the longitudinal axis $A_{10}$ and tapers in width along a direction from the front surface 152 to the apex 160. A depth of the relief 158 extends from the portion of the upper side 128 defined by the anterior support segment 144 and flush with the support surface 156 of the intermediate portion 154.

Referring to FIGS. 1 and 2, when the sole structure 100 is assembled, the length $L_{134}$ of the receptacle 134 is sufficient to provide gaps 162, 164 between the cushioning arrangement 108 and the respective end surfaces 152, 153. For example, the length $L_{134}$ of the receptacle may be greater than a length $L_{178}$ of the platform, whereby the gaps 162, 164 defined by opposite ends of the receptacle 134 extend beyond the first platform end 184 and the second platform end 186, as discussed in greater detail below. The gaps 162, 164 include a first gap 162 disposed between the front surface 152 and the cushioning arrangement 108 and a second gap 164 disposed between the second end surface 153 and the cushioning arrangement 108. The gaps 162, 164 provide an expansion space between the cushioning arrangement 108 and the lower cushioning member 118. Thus, when the forefoot region 20 of the sole structure 100 is compressed, the cushioning arrangement 108 and the lower cushioning member 118 may deform and extend into the gaps 162, 164 without contacting each other or the end surfaces 152, 153.

As described above, the components 116, 118 of the cushioning element 106 are formed of a resilient polymeric material, such as foam or rubber, to impart properties of cushioning, responsiveness, and energy distribution to the foot of the wearer. In the illustrated example, the upper cushioning member 116 includes a first foam material and the lower cushioning member 118 includes a second foam material. For example, the upper cushioning member 116 may include first foam materials providing greater cushioning and impact distribution, while the lower cushioning member 118 includes a foam material having a greater hardness or stiffness in order to provide increased stability to the bottom of the sole structure 100.

Example resilient polymeric materials for the cushioning element 106 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., crosslinked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a crosslinking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

Figure 15:
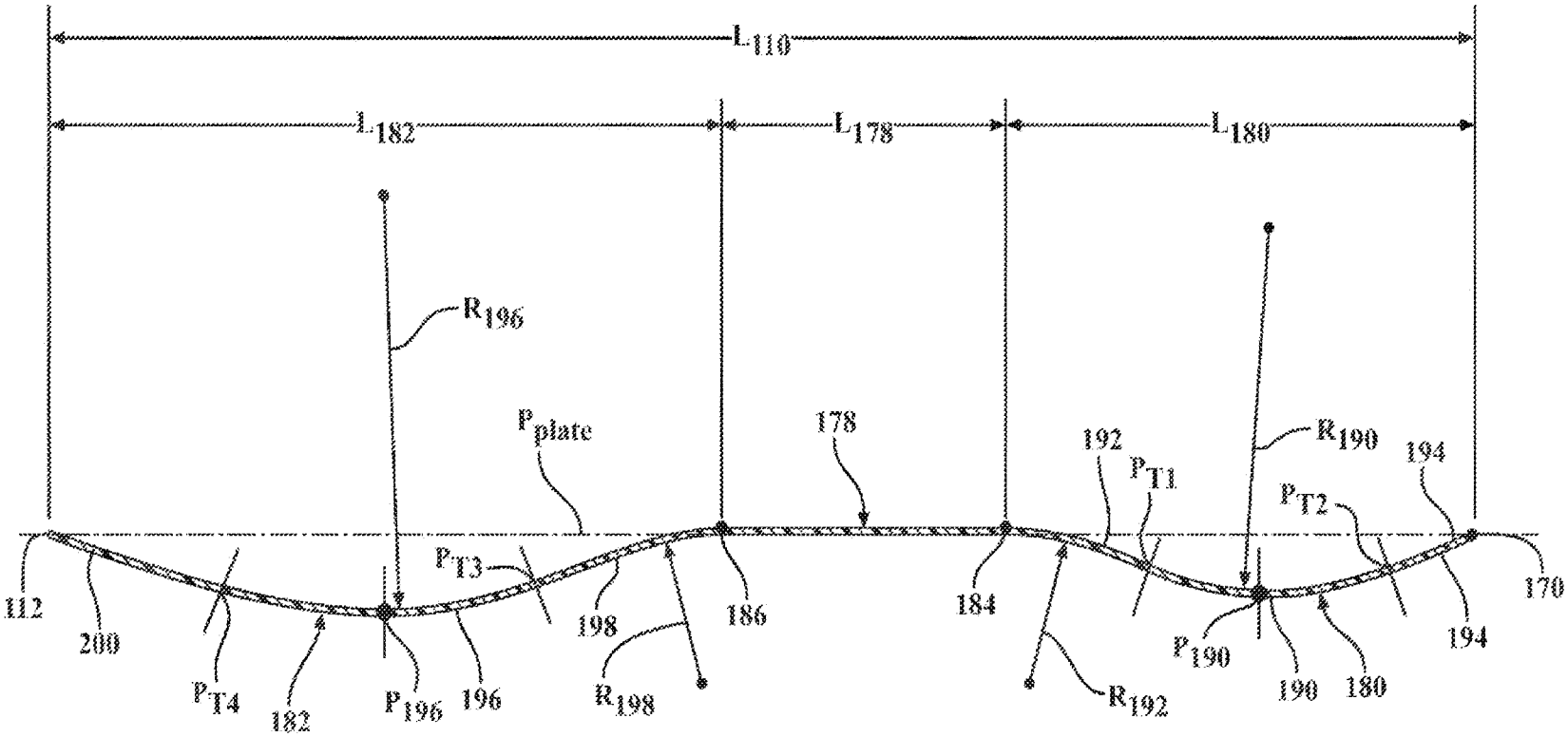
FIG. 15 is a cross-sectional view of the plate of the sole structure of FIG. 1, taken along Line 8-8 in FIG. 7.

With continued reference to FIGS. 8A and 15, the plate 110 is disposed between the upper cushioning member 116 and the lower cushioning member 118 and defines a total length Luo extending along a direction of the longitudinal axis $A_{10}$ from a first end 170 in the toe portion $\mathbf{20}_T$ to a second end 172 in the heel region 26. As shown, the total length Luo of the plate 110 is less than a length $L_{106}$ of the cushioning element 106 measured from the first end 112 to the second end 114 at the joint between the upper cushioning member 116 and the lower cushioning member 118. In other words, the first end 170 and the second end 172 of the plate 110 are offset inwardly from each of the first end 112 and the second end 114 of the cushioning element 106. In the illustrated example, the total length Luo of the plate 110 ranges from 75% to 85% of the length $L_{106}$ of the cushioning element 106 and, more particularly, is approximately 80% of the length $L_{106}$ of the cushioning element 106. Relative to the sole structure 100, the second end 172 of the plate 110 terminates at a location between the calcaneus point $Pt_{calc}$ that corresponds to the calcaneus bone of the foot when the footwear 10 is donned by user. In other words, the plate 110 is configured such that the second end 172 does not extend below the calcaneus bone of the foot during use.

The plate 110 and features thereof may be described as including a top side 174 facing the upper 300 and an opposite bottom side 176 facing the outsole 104, whereby a distance from the top side 174 to the bottom side 176 defines a thickness of the plate 110. In some implementations, the plate 110 includes a substantially uniform thickness. Thus, it will be understood that the top side 174 of the plate 110 and the bottom side of the plate 176 have corresponding profiles. For example an arcuate portion of the plate 110 that defines a concavity on one of the top side 174 or the bottom side 176 also defines a corresponding convexity on the other of the top side or the bottom side 176. In some examples, the thickness of the plate 110 ranges from about 0.6 millimeters (mm) to about 3.0 mm. In one example, the thickness of the plate 110 is substantially equal to one 1.0 mm. In other implementations, the thickness of the plate 110 is non-uniform such that the plate 110 may have a greater thickness in one region 20, 22, 24 of the sole structure 100 than the thicknesses in the other regions 20, 22, 24.

The plate 110 includes a material providing relatively high strength and stiffness, such as polymeric material and/or composite materials. In some examples, the plate 110 is a composite material manufactured using fiber sheets or textiles, including pre-impregnated (i.e., "prepreg") fiber sheets or textiles. Alternatively or additionally, the plate 110 may be manufactured by strands formed from multiple filaments of one or more types of fiber (e.g., fiber tows) by affixing the fiber tows to a substrate or to each other to produce a plate having the strands of fibers arranged predominately at predetermined angles or in predetermined positions. When using strands of fibers, the types of fibers included in the strand can include synthetic polymer fibers which can be melted and re-solidified to consolidate the other fibers present in the strand and, optionally, other components such as stitching thread or a substrate or both. Alternatively or additionally, the fibers of the strand and, optionally the other components such as stitching thread or a substrate or both, can be consolidated by applying a resin after affixing the strands of fibers to the substrate and/or to each other. In other configurations, the plate 110 includes one or more layers/plies of unidirectional tape. In some examples, each layer in the stack includes a different orientation than the layer disposed underneath. The plate 110 may be formed from unidirectional tape including at least one of carbon fibers, boron fibers, glass fibers, and polymeric fibers. In some examples, the one or more materials forming the plate 110 include a Young's modulus of at least 70 gigapascals (GPa).

With continued reference to FIG. 8A, the plate 110 is includes an intermediate platform 178 and a pair of arcuate segments 180, 182 extending from opposite ends of the intermediate platform 178. For the sake of describing the geometries of the plate 110, reference will be made to the profiles of the bottom side 176. Thus, reference to a "planar" geometry or an "arcuate" geometry is directed to the bottom side 176 of the plate 110 unless otherwise stated. However, as noted above, it should be understood that the top side 174 of the plate 110 would have a complementary profile, such that a convex surface on the bottom side 176 equates to a concave surface on the top side 174, and vice versa.

The platform 178 defines a substantially planar portion of the plate 110 extending through the midfoot region 22 of the sole structure 100 from a first platform end 184 to a second platform end 186. Particularly, the platform 178 opposes the tray 154 of the lower cushioning member 118, whereby the bottom side 176 of the platform 178 is spaced part from the tray 154 to define a height of the receptacle 134. As previously discussed, when installed in the sole structure 100, the platform 178 is generally oriented parallel to the MTP reference plane $Pl_{MTP}$ and at an oblique angle relative to the footbed plane $Pl_{footbed}$. For example, the platform 178 may be oriented at approximately a five (5) degree incline relative to the footbed plane $Pl_{footbed}$. The platform 178 is parallel to the support surface 156 of the tray 154 such that the receptacle 134 has a substantially constant height for receiving the cushioning arrangement 108. Additionally, the platform 178 is substantially parallel with a portion of the ground-engaging 101 surface of the sole structure 100 extending along the opposite side of the tray 154 from the support surface 156. In other words, although the ground-engaging surface 101 is shown as being generally convex from the first end 112 to the second end 114, the portion of the ground-engaging surface 101 associated with the midfoot region (e.g., a tangent point aligned with the cushioning arrangement 108 at the MTP joint) is formed at an oblique angle $\theta_{MTP}$ relative to the footbed plane $Pl_{footbed}$.

As shown in FIG. 8A, the curvature of the ground-engaging surface 101 of the sole structure 100 is such that the portion of the ground-engaging surface 101 adjacent to the posterior end 12 of the sole structure 100 is closer to the footbed plane $Pl_{footbed}$ than an upper-most portion of the cushioning arrangement 108. Additionally or alternatively, the ground-engaging surface 101 of the sole structure 100 may be provided with a variable curvature from the anterior end 12 to the posterior end 14. For example, the radius of curvature associated with the ground-engaging surface 101 may increase along the direction from the anterior end 12 to the posterior end 14, such that a portion of the ground-engaging surface 101 in the forefoot region 20 has a lesser radius than a portion of the ground-engaging surface in the heel region 24.

Referring still to FIGS. 8A and 15, the plate 110 further includes an anterior arcuate segment 180 extending from the first platform end 184 to the first end 170 of the plate 110. In other words, the first end 170 of the plate 110 defines a distal or terminal end of the anterior arcuate segment 180. The anterior arcuate segment 180 includes a compound curvature defining an anterior cambered segment 190 having a convex profile, an anterior transition segment 192 having an opposite concave profile between the anterior cambered segment 190 and the first platform end 184, and an anterior tip segment 194 extending between the anterior cambered segment 190 and the first end 170. As shown, the anterior cambered segment 190 has a first radius of curvature $R_{190}$ defining the convexity and the anterior transition segment 192 has a second radius of curvature $R_{192}$ in the opposite direction than the first radius of curvature $R_{190}$. The anterior transition segment 192 is generally tangentially formed with each of the platform 178 and the anterior cambered segment 190. The anterior tip segment 194 may be planar or have a larger radius of curvature than the anterior cambered segment 190, whereby the anterior tip segment 194 defines a flatter portion of the plate 110 adjacent to the first end 170.

With continued reference to FIG. 8A, the plate 110 further includes the posterior arcuate segment 182 extending from the second platform end 186 to the second end 172 of the plate 110. In other words, the second end 172 of the plate 110 defines a distal or terminal end of the posterior arcuate segment 182. The posterior arcuate segment 182 includes a compound curvature defining a posterior cambered segment 196 having a convex profile, a posterior transition segment 198 having an opposite concave profile between the posterior cambered segment 196 and the second platform end 186, and a posterior tip segment 200 extending between the posterior cambered segment 196 and the second end 172. As shown, the posterior cambered segment 196 has a third radius of curvature $R_{196}$ defining the convexity and the posterior transition segment 198 has a fourth radius of curvature $R_{198}$ in the opposite direction than the third radius of curvature. The posterior transition segment 198 is generally tangentially formed with each of the platform 178 and the posterior cambered segment 196. The posterior tip segment 200 may be planar or have a larger radius of curvature than the posterior cambered segment 196, whereby the posterior tip segment 200 defines a flatter portion of the plate 110 adjacent to the second end 172.

With continued reference to FIG. 8A, and as previously discussed, the length $L_{134}$ of the receptacle may be greater than a length $L_{178}$ of the platform, whereby the gaps 162, 164 defined by opposite ends of the receptacle 134 extend beyond the first platform end 184 and the second platform end 186, as discussed in greater detail below. Particularly, the first gap 162 disposed between the front surface 152 and the cushioning arrangement 108 extends along the anterior transition segment 192 of the anterior arcuate segment 180, whereby the anterior transition segment 192 can flex into the first gap 162 under load. Similarly, the second gap 164 disposed between the rear surface 153 and the cushioning arrangement 108 extends along the posterior transition segment 198 of the posterior arcuate segment 182, whereby the posterior transition segment 198 can flex into the second gap 164 under load.

Referring still to FIG. 8A, the plate 110 is configured in a manner such that when the plate 110 is assembled within the sole structure 100, the anterior cambered segment 190 and the posterior cambered segment 196 generally complement the profile of the ground-engaging surface of the sole structure 100. More particularly, the ground-engaging surface of the sole structure 100 is provided with a continuous convex shape from the first end 112 to the second end 114, whereby when the sole structure 100 is in the resting state (FIG. 8A) the ground-engaging surface is generally tangent to the ground-reference plane at the midfoot region 22 and curves away from the ground-reference plane $Pl_{ground}$ in the forefoot region 20 and the heel region 24. Thus, each of the anterior cambered segment 190 and the posterior cambered segment 196 also curve away from the ground reference plane $Pl_{ground}$ (i.e., towards the footbed plane $Pl_{footbed}$) in the forefoot region 20 and the heel region 24. In the illustrated example, the anterior cambered segment 190 is oriented at a lesser angle than the corresponding portion of the ground-engaging surface in the toe portion $\mathbf{20}_T$, whereby the anterior cambered segment 190 and the ground-engaging surface converge along a direction towards the anterior end 12. Conversely, the posterior cambered segment 196 is oriented generally parallel to or slightly divergent from the ground-engaging surface in the heel region 26.

Referring now to FIG. 15, the geometries and features of the plate 110 are described in greater detail and relative to a local plate reference plane $Pl_{plate}$ defined by the platform 178. Particularly, the plate reference plane $Pl_{plate}$ is generally associated or coincident with the planar profile of the platform 178 and extends through each of the first platform end 184 and the second platform end 186. Although the platform 178 and the plate reference plane $Pl_{plate}$ are oriented at an oblique angle relative to the footbed plane $Pl_{footbed}$, FIG. 15 provides the plate 110 with the plate reference plane $Pl_{plate}$ in a horizontal orientation for the sake of defining the geometries of the plate 110.

Figure 16:
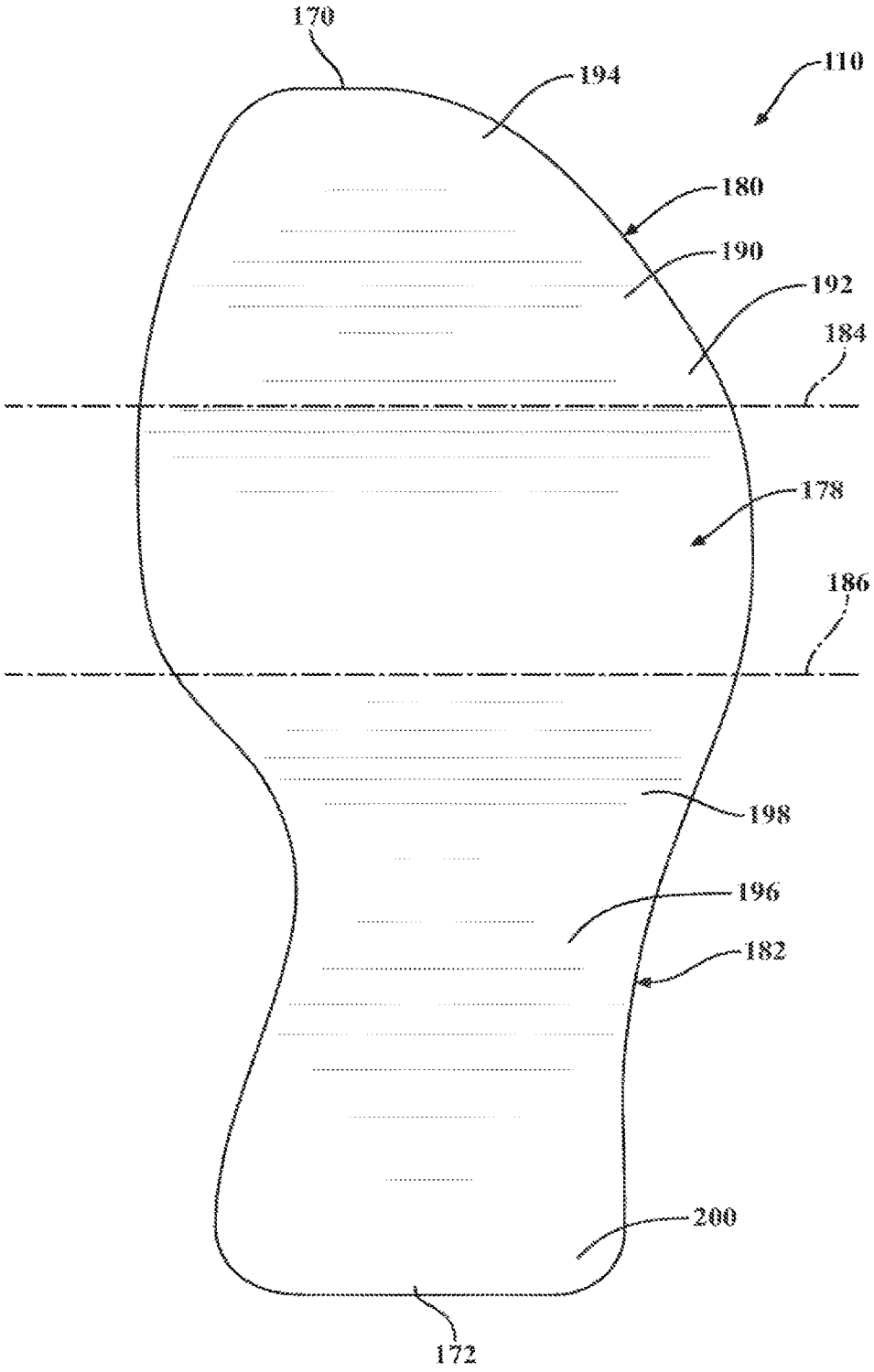
FIG. 16 is a top plan view of the plate of the sole structure of FIG. 1.

Referring still to FIG. 15, the platform 178 has a length $L_{178}$ extending from the first platform end 184 to the second platform end 186. The anterior arcuate segment 180 defines a length $L_{180}$ extending from the first platform end 184 to the first end 170 of the plate 110 and the posterior arcuate segment 182 defines a length of the plate 110 extending from the second platform end 186 to the second end 172 of the plate 110. As best shown in FIG. 16, the second end 172 of the plate 110 may be blunted or straight from the medial side 16 to the lateral side 18 to minimize the overall weight of the sole structure 100.

In combination, the lengths $L_{178}$, $L_{180}$, $L_{182}$, of the plate portions 178, 180, 182 define the overall length Luo of the plate 110. In the illustrated example, the length $L_{178}$ of the platform 178 ranges from 16% to 26% of the total length of the plate 110 and, more particularly, is approximately 21% of the total length of the plate 110. The length $L_{180}$ of the anterior arcuate segment 180 ranges from 27% to 37% of the total length of the plate 110 and, more particularly, is approximately 32% of the total length of the plate 110. The length $L_{182}$ of the posterior arcuate segment 182 ranges from 42% to 52% of the total length of the plate 110 and, more particularly, is approximately 47% of the total length of the plate 110.

As shown in FIG. 15, each of the anterior arcuate segment 180 and the posterior arcuate segment 182 are arranged on the same side of the plate reference plane $Pl_{plate}$. More particularly, the anterior transition segment 192 defines a first convex curvature that diverges from the plate reference plane $Pl_{plate}$ to a first transition point $P_{T1}$ between the anterior transition segment 192 and the anterior cambered segment 190. The first transition point $P_{T1}$ defines the point of the anterior arcuate segment 180 where the convex curvature of the anterior transition segment 192 meets the concave curvature of the anterior cambered segment 190. From the first transition point $P_{T1}$, the anterior cambered segment 190 extends along the concave radius of curvature $R_{190}$ to an anterior plate apex point $P_{190}$. The radius of curvature $R_{190}$ continues through the anterior plate apex point $P_{190}$ to a second transition point $P_{T2}$ between the anterior cambered segment 190 and the anterior tip segment 194, where the radius of the plate 110 increases or flattens. As shown, the anterior arcuate segment 180 extends to the first end 170 of the plate 110, which is coplanar with the platform 178 (i.e., aligned along the plate reference plane $Pl_{plate}$).

The posterior transition segment 198 defines a first convex curvature that diverges from the plate reference plane $Pl_{plate}$ to a third transition point $P_{T3}$ between the posterior transition segment 198 and the posterior cambered segment 196. The third transition point $P_{T3}$ defines the point of the posterior arcuate segment 182 where the convex curvature of the posterior transition segment 198 meets the concave curvature of the posterior cambered segment 196. From the third transition point $P_{T3}$, the posterior cambered segment 196 extends along the concave radius of curvature $R_{196}$ to a posterior plate apex point $P_{196}$. The radius of curvature $R_{196}$ continuous through the posterior plate apex point $P_{196}$ to a fourth transition point $P_{T4}$ between the posterior cambered segment 196 and the posterior tip segment 200, where the radius of the plate 110 increases or flattens. As shown, the posterior arcuate segment 182 extends to the second end 172 of the plate 110, which is coplanar with the platform 178 (i.e., aligned along the plate reference plane $Pl_{plate}$). Thus, each of the first end 170 and the second end 172 of the plate 110 are coplanar with the plate reference plane $Pl_{plate}$ defined by the platform 178.

Figure 11:
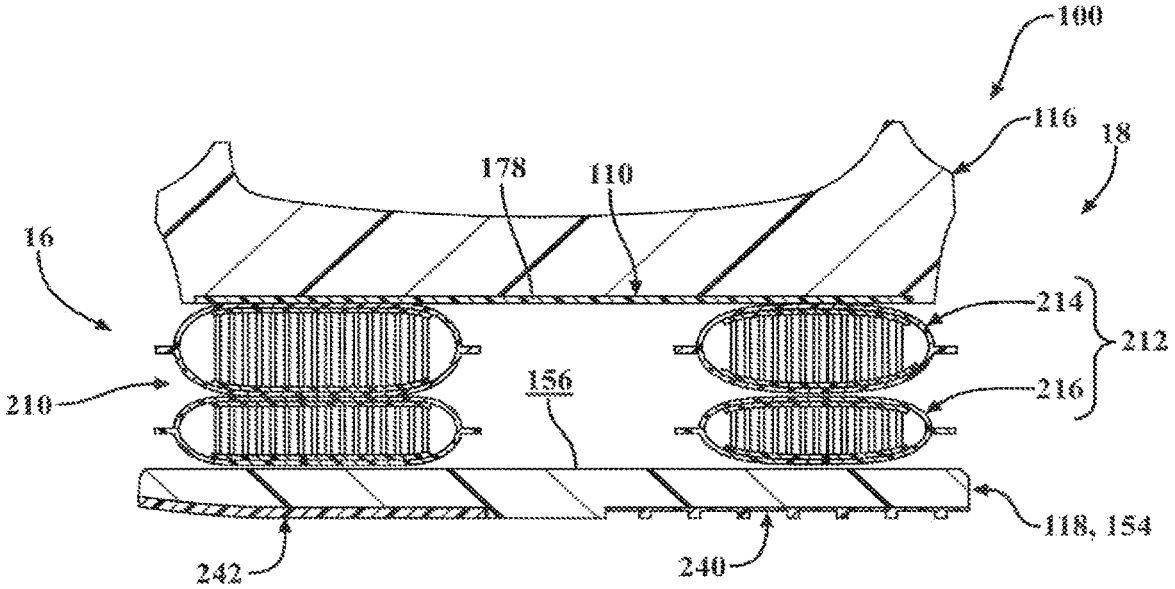
FIG. 11 is a cross-sectional view of the sole structure of FIG. 1, taken along Line 11-11 in FIG. 7.

With particular reference to FIGS. 10 and 11, the cushioning arrangement 108 is shown to include a medial cushion or cushioning structure 210 and a lateral cushion or cushioning structure 212. The medial cushioning structure 210 is disposed proximate to the medial side 16 of the sole structure 100 while the lateral cushioning structure 212 is disposed proximate to the lateral side 18 of the sole structure 100. As shown in FIG. 10, each of the medial cushioning structure 210 and the lateral cushioning structure 212 includes an upper bladder 214 and a lower bladder 216. As referred to herein, the cushioning arrangement 108 includes a central axis $A_{108}$ extending along a thickness direction of the cushioning arrangement 108 between top and bottom sides.

Each of the bladders 214, 216 may include a pair of barrier layers 218 formed and joined together along a peripheral seam to define a chamber 220 within the bladder 214, 216. Here, an upper barrier layer 218 defines a top side of the bladder 214, 216 and a lower barrier layer 218 defines a bottom side of each bladder 214, 216.

As used herein, the term "barrier layer" (e.g., barrier layers 218) encompasses both monolayer and multilayer films. In some embodiments, one or both of the barrier layers 218 are each produced (e.g., thermoformed or blow molded) from a monolayer film (a single layer). In other embodiments, one or both of the barrier layers 218 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 218 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 218 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier layers 218 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 218 include two or more sublayers, examples of suitable multilayer films include microlayer films, such as those disclosed in Bonk et al., U.S. Pat. No. 6,582,786, which is incorporated by reference in its entirety. In further embodiments, barrier layers 218 may each independently include alternating sublayers of one or more TPU copolymer materials and one or more EVOH copolymer materials, where the total number of sublayers in each of the barrier layers 218 includes at least four (4) sublayers, at least ten (10) sublayers, at least twenty (20) sublayers, at least forty (40) sublayers, and/or at least sixty (60) sublayers.

The bladders 214, 216 can be produced from the barrier layers 218 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 218 can be produced by co-extrusion followed by vacuum thermoforming to produce an inflatable chamber 220, which can optionally include one or more valves (e.g., one way valves) that allows the chamber 220 to be filled with the fluid (e.g., gas).

The chamber 220 can be provided in a fluid-filled (e.g., as provided in footwear 10) or in an unfilled state. The chamber 220 can be filled to include any suitable fluid, such as a gas or liquid. In an aspect, the gas can include air, nitrogen ($N_2$), or any other suitable gas. In other aspects, the chamber 220 can alternatively include other media, such as pellets, beads, ground recycled material, and the like (e.g., foamed beads and/or rubber beads). The fluid provided to the chamber 220 can result in the chamber 220 being pressurized. Alternatively, the fluid provided to the chamber 220 can be at atmospheric pressure such that the chamber 220 is not pressurized but, rather, simply contains a volume of fluid at atmospheric pressure.

The fluid-filled chamber 220 desirably has a low gas transmission rate to preserve its retained gas pressure. In some embodiments, the fluid-filled chamber 220 has a gas transmission rate for nitrogen gas that is at least about ten (10) times lower than a nitrogen gas transmission rate for a butyl rubber layer of substantially the same dimensions. In an aspect, fluid-filled chamber 220 has a nitrogen gas transmission rate of 15 cubic-centimeter/square-meter·atmosphere·day ($cm^3/m^2 \cdot atm \cdot day$) or less for an average film thickness of 500 micrometers (based on thicknesses of the barrier layers 218). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

The chamber 220 of each of the bladders 214, 216 may receive a tensile element 222*a*, 222*b* (FIG. 8A) therein. Each tensile element 222*a*, 222*b* may include a series of tensile strands 224 extending between an upper tensile sheet 226 and a lower tensile sheet 228. The upper tensile sheet 226 may be attached to a first one of the barrier layers 218 while the lower tensile sheet 226 may be attached to a second one of the barrier layers 218. In this manner, when the chamber 220 receives the pressurized fluid, the tensile strands 224 of the tensile element 222*a*, 222*b* are placed in tension. Because the upper tensile sheet 226 is attached to the upper barrier layer 218 and the lower tensile sheet 228 is attached to the lower barrier layer 218, the tensile strands 224 retain a desired shape of the bladders 214, 216 when the pressurized fluid is injected into the chamber 220.

In the illustrated example, the heights of the upper bladders 214 and the lower bladders 216 cooperate to define an overall height of the cushioning structures 210, 212, which corresponds to the height $H_{134}$ of the receptacle 134. Optionally, the bladders 214, 216 of each cushioning structure 210, 212 have different dimensions. For instance, the upper bladder 214 in each cushioning structure 210, 212 may have a greater height and a lesser width than the lower bladder 216 of the cushioning structure 210, 212, as best shown in FIGS. 8 and 10. In some instances, the bladders 214, 216 include the same barrier layers 218, whereby the dimensions of the bladders 214, 216 are defined by selecting a desired tensile element 222*a*, 222*b*. For example, the upper bladder 214 may include a tensile element 222*a* having tensile strands 224*a* that are longer than the tensile strands 224*b* of a tensile element 222*b* used in the lower bladder 216. Thus, when the upper bladder 214 is inflated, the tensile element 222*a* of the upper bladder 214 allows the barrier layers 218 of the upper bladder 214 to move apart from each other to a greater extent, thereby reducing the overall width relative to the lower bladder 216.

When the sole structure 100 is assembled, the lower barrier layer 218 of each of the lower bladders 216 is received on the support surface 156 of the tray 154 such that the cushioning arrangement 108 is supported on the foam material of the lower cushioning member 118. Conversely, the upper barrier layer 218 of each of the upper bladders 214 is received against the bottom side 176 of the platform 178 of the plate 110. In this example, the upper barrier layer 218 of the lower bladder 216 supports and is attached to the lower barrier layer 218 of the upper bladder 214. Thus, by providing the lower bladder 216 with an increased width and reduced height relative to the upper bladder 214, the lower bladder 216 may serve as a functional base of each cushioning structure 210, 212.

While the illustrated example of the cushioning arrangement 108 includes the cushioning structures 210, 212 including the upper and lower bladders 214, 216 of difference sizes, other examples of the sole structure 100 may be provided with medial and lateral cushioning structures each including upper and lower bladders having the same size and shape. In other examples, the cushioning arrangement 108 may include medial and lateral cushioning structures each including only a single, column-shaped bladder. In other examples, the cushioning arrangement may include elongate upper and lower bladders arranged in a single stack, whereby each bladder extends from a first end at the medial side 16 to a second end at the lateral side 18. In yet another example, the cushioning arrangement 108 may include a single bladder extending between the medial side and the lateral side and having a height corresponding to the height $H_{134}$ of the receptacle.

With continued reference to FIGS. 3, 4, and 7, the outsole 104 includes a lateral section 240, an anterior medial section 242, and a posterior medial section 244. The lateral section 240 extends continuously along the lateral side 18 of the footwear 10 from the anterior end 12 to the posterior end 14. The anterior medial section 242 extends continuously along the medial side 16 from the anterior end 12 to a second end 246 in the midfoot region 22. As shown, the second end 246 of the anterior medial section 242 has a convex profile. The posterior medial section 244 extends from a first end 248 in the midfoot region 22 to the posterior end 14. The first end 248 of the posterior medial section 244 is adjacent to and has a complementary profile (e.g., concave) to the second end 246 of the anterior medial section 242.

Figure 12:
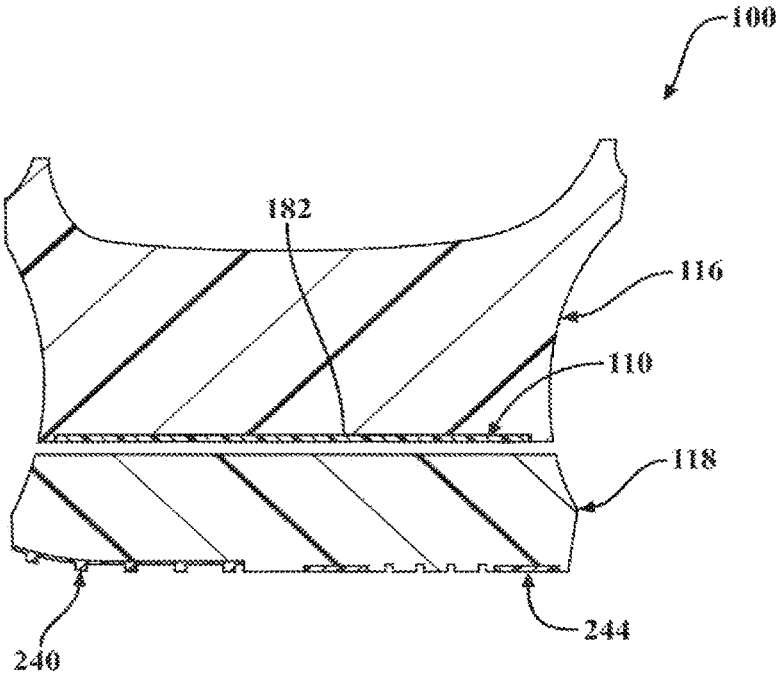
FIG. 12 is a cross-sectional view of the sole structure of FIG. 1, taken along Line 12-12 in FIG. 7.
Figure 13:
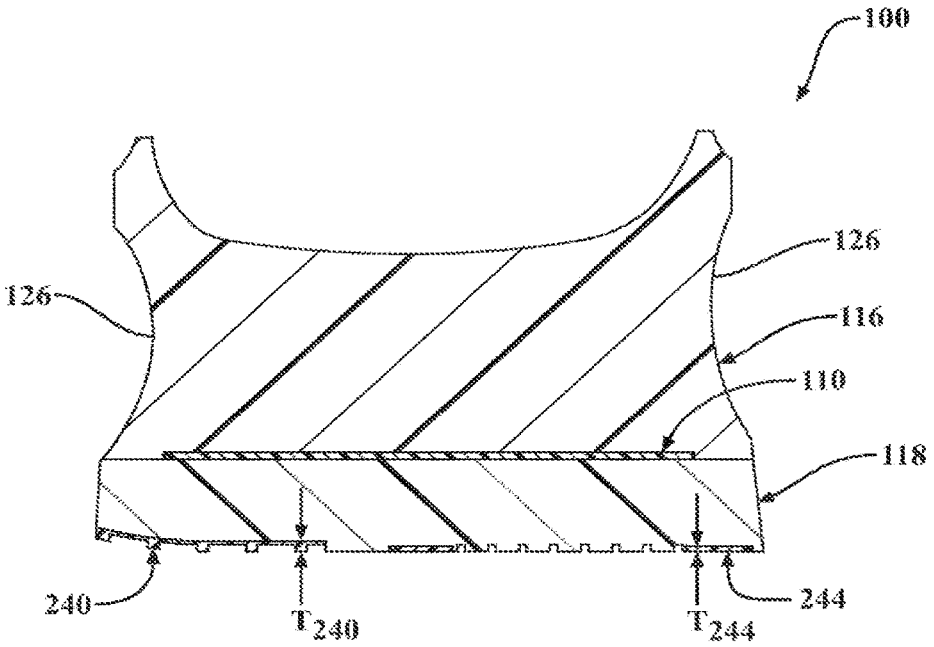
FIG. 13 is a cross-sectional view of the sole structure of FIG. 1, taken along Line 13-13 in FIG. 7.
Figure 14:
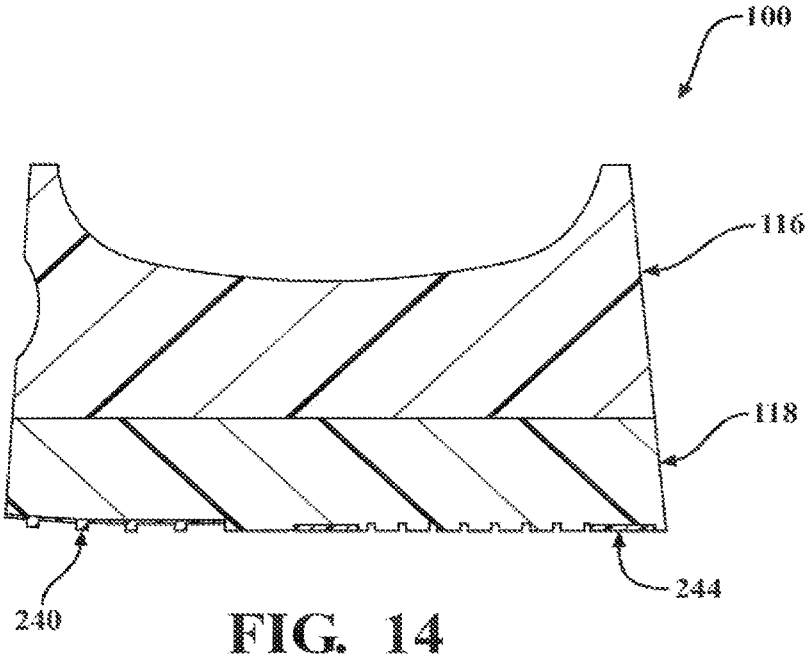
FIG. 14 is a cross-sectional view of the sole structure of FIG. 1, taken along Line 14-14 in FIG. 7.

As shown in FIG. 7, the posterior medial section 244 of the outsole 104 may include a peripheral band or strip 250 of outsole material surrounding an opening 252 that exposes the bottom side 130 of the lower cushioning member 118. The strip 250 includes an inner segment 254 extending along the longitudinal axis $A_{100}$ and an outer segment 256 extending generally along the peripheral side 132 of the lower cushioning member 118. A first end segment 258 connects the inner segment 254 and the outer segment 256 at the first end 248. Further, as shown in FIGS. 12-14, the posterior medial section 244 of the outsole 104 may have a reduced thickness $T_{244}$ relative to the other outsole sections 240, 242. It is noted that a posterior medial region of a ground-engaging surface 101 of a sole structure 100 is typically subjected to less frequent and less severe ground-engagement forces than the forefoot and lateral regions of the sole structure 100. Thus, by forming the posterior medial section 244 with the opening and the reduced thickness, the overall weight of the sole structure 100 is reduced by minimizing outsole material in low-engagement regions of the sole structure 100.

The lateral section 240 is separated from the medial sections 242, 244 by an elongate gap 260 extending continuously along the longitudinal axis $A_{10}$ from the anterior end 12 to the posterior end 14. This gap 260 allows the lateral section 240 to move independently of the medial sections 242, 244 along the bottom side 130 of the lower cushioning member 118. Thus, while all of the outsole sections 240, 244, 244 are connected to the bottom side 130 of the lower cushioning member 118, the resiliency of the lower cushioning member 118 facilities a degree of relative movement between different regions of the bottom side 130. As best shown in FIGS. 10 and 11, the gap 260 is aligned with a gap between the medial and lateral cushioning structures 210, 212, thereby providing an increased degree of relative movement between the cushioning structures 210, 212 at the lower cushioning member 118.

The upper 300 forms an enclosure having plurality of components that cooperate to define an interior void 302 and an ankle opening 304, which cooperate to receive and secure a foot for support on the sole structure 100. The upper 300 may be formed from one or more materials that are stitched or adhesively bonded together to define the interior void 302. Suitable materials of the upper 300 may include, but are not limited to, textiles, foam, leather, and synthetic leather. The example upper 300 may be formed from a combination of one or more substantially inelastic or non-stretchable materials and one or more substantially elastic or stretchable materials disposed in different regions of the upper 300 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

Figure 8B:
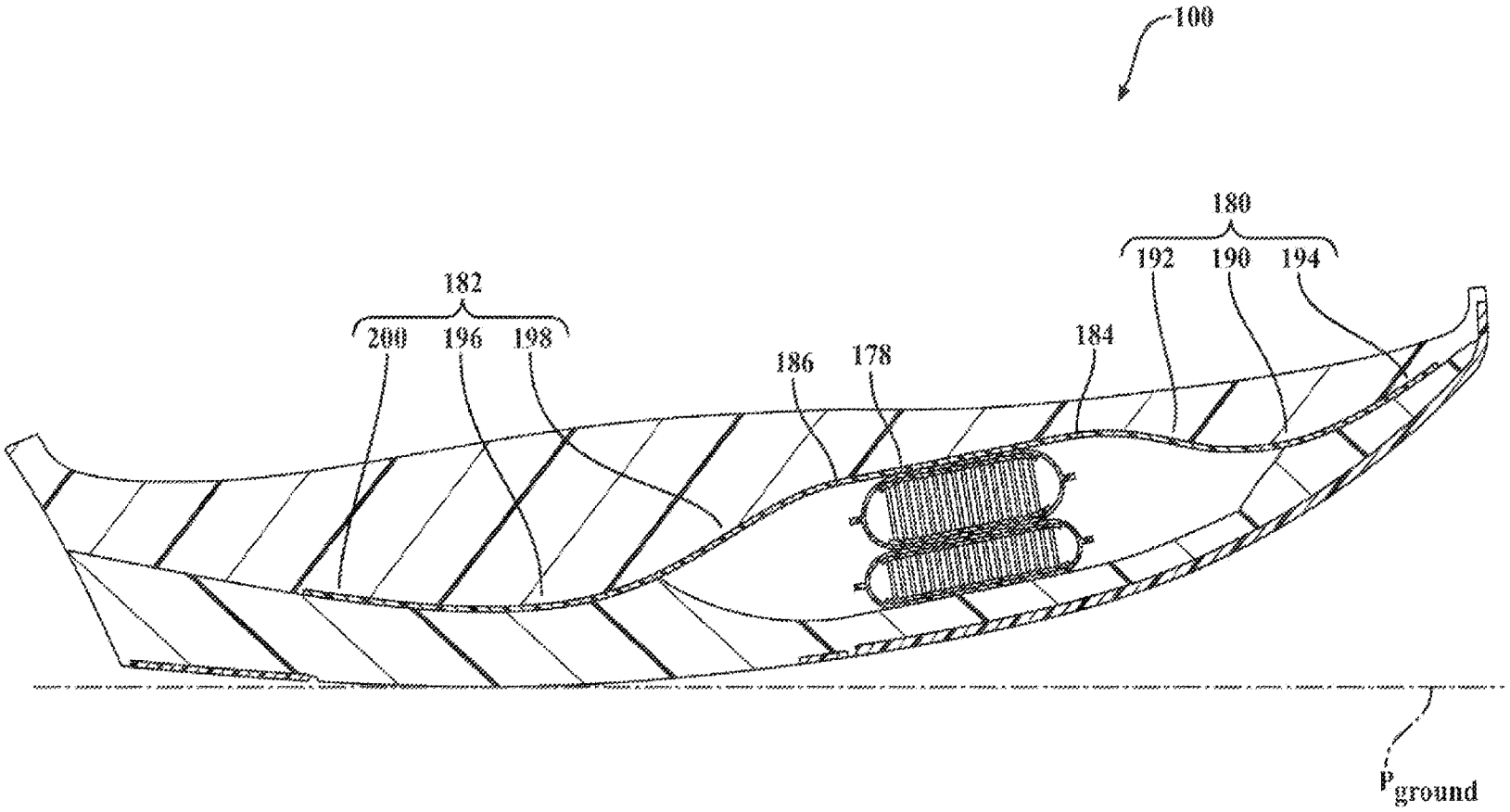
FIG. 8B is a cross-sectional view of the sole structure of FIG. 1, taken along Line 8-8 in FIG. 7 and showing the sole structure in an initial contact phase of a gait cycle.
Figure 8C:
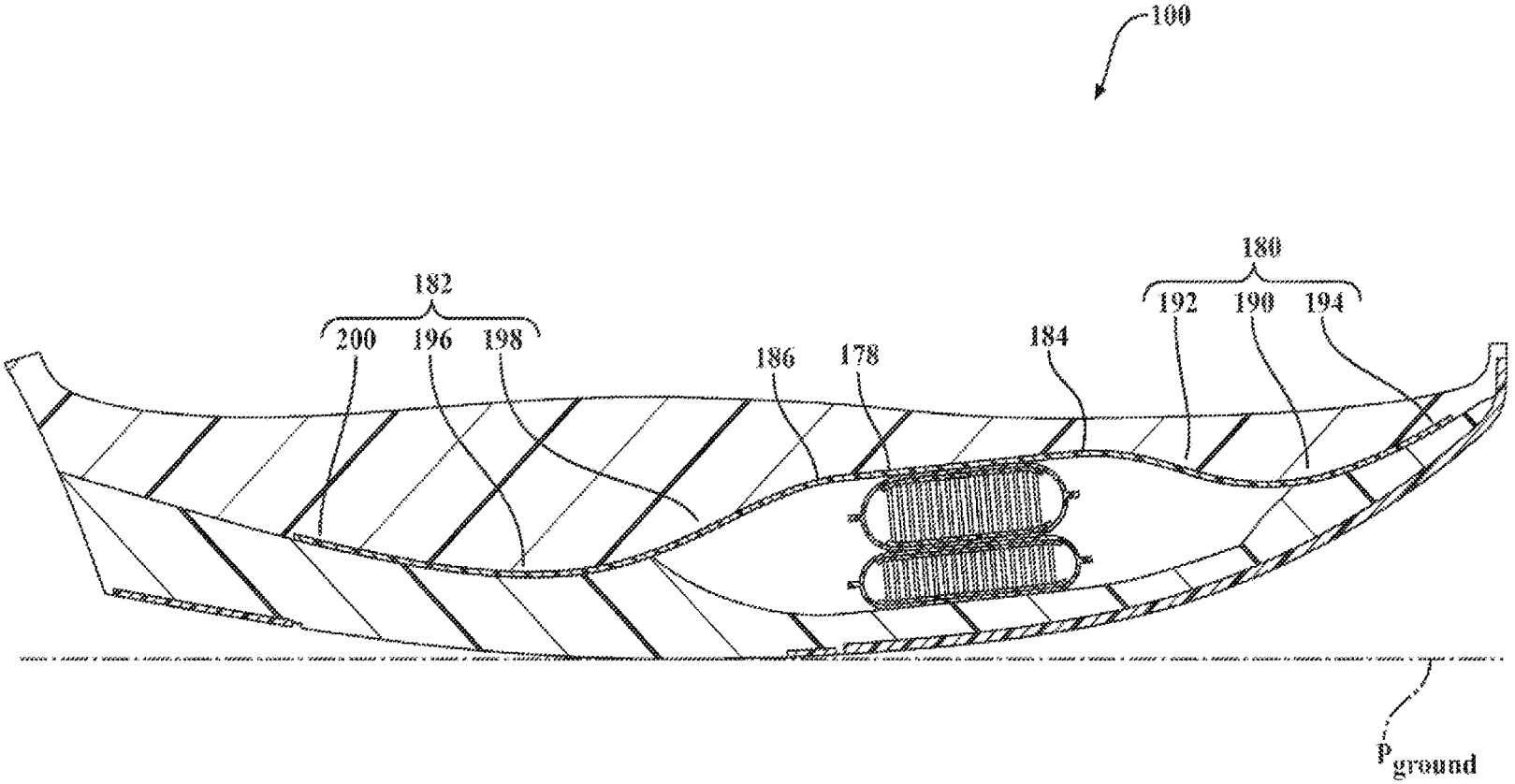
FIG. 8C is a cross-sectional view of the sole structure of FIG. 1, taken along Line 8-8 in FIG. 7 and showing the sole structure in a loading response phase of a gait cycle.
Figure 8D:
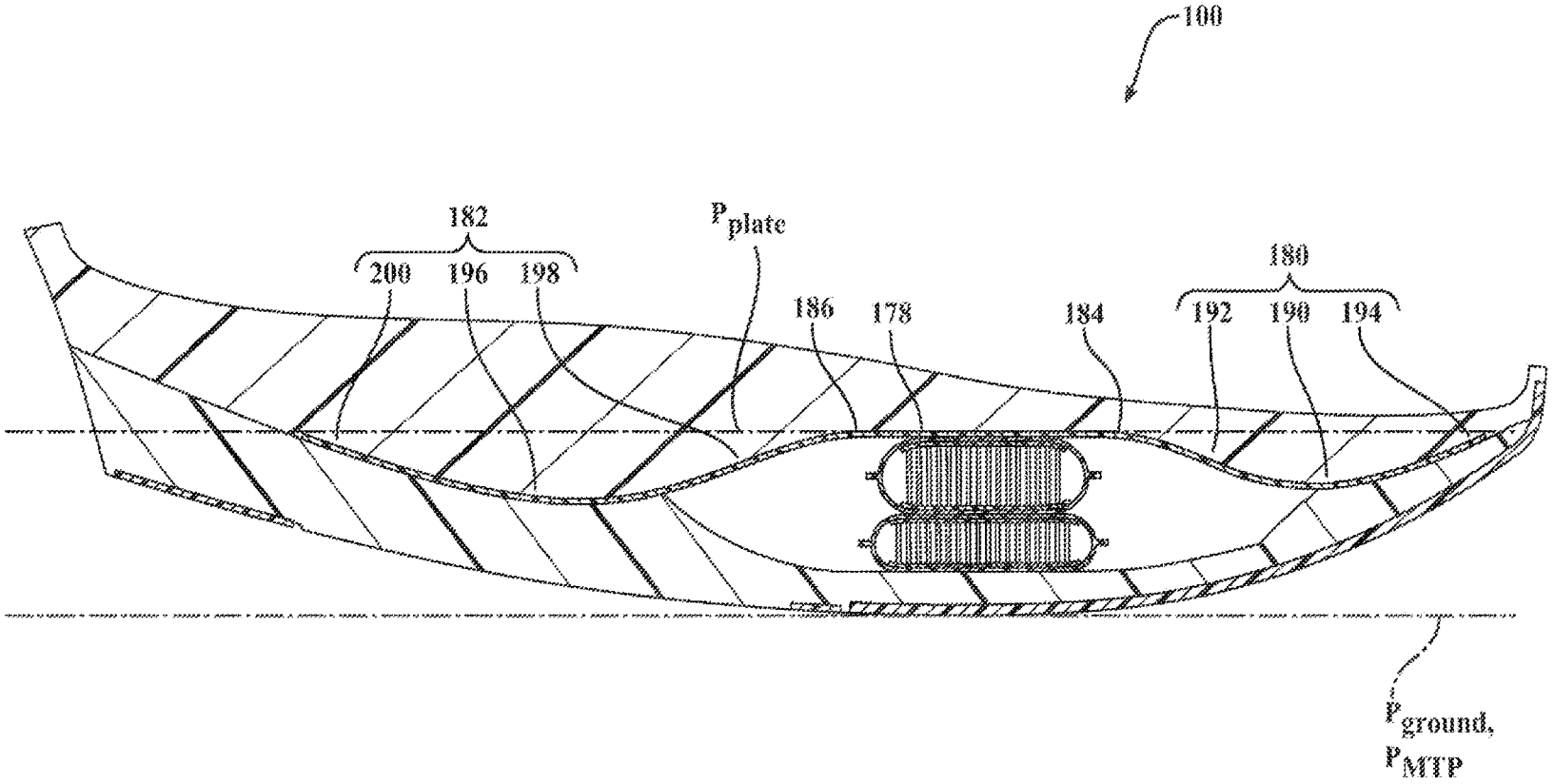
FIG. 8D is a cross-sectional view of the sole structure of FIG. 1, taken along Line 8-8 in FIG. 7 and showing the sole structure in a terminal stance phase of a gait cycle.
Figure 8E:
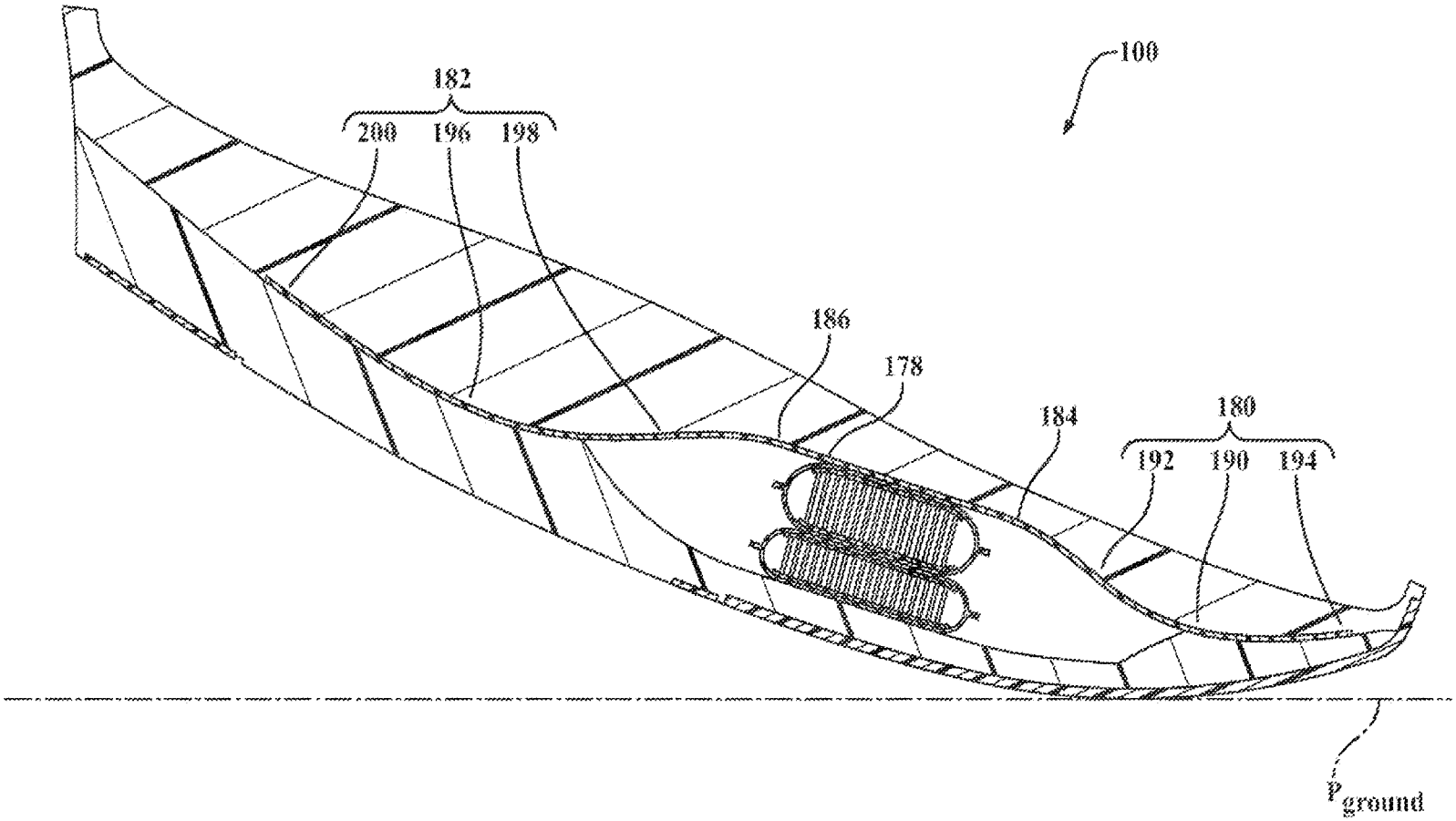
FIG. 8E is a cross-sectional view of the sole structure of FIG. 1, taken along Line 8-8 in FIG. 7 and showing the sole structure in a push-off phase of a gait cycle.
Figure 9:
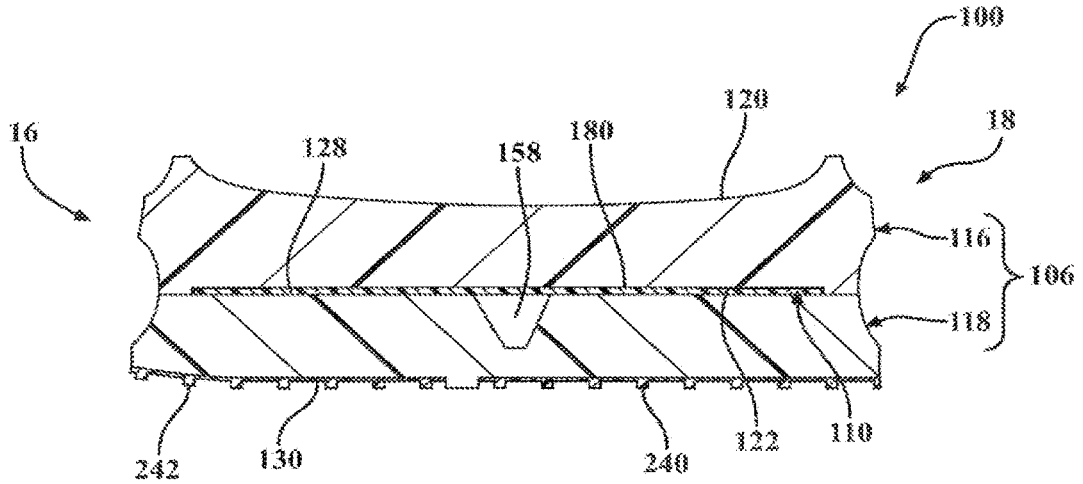
FIG. 9 is a cross-sectional view of the sole structure of FIG. 1, taken along Line 9-9 in FIG. 7.

With reference to FIGS. 8B-8E, the advantages of the sole structure 100 during use are illustrated. At FIG. 8A, the sole structure 100 is shown in a resting state, whereby the footbed plane $Pl_{footbed}$ is substantially parallel to the ground reference plane $Pl_{ground}$. In the resting state, weight applied by the plantar surface of the foot is evenly distributed along the length $L_{110}$ of the sole structure 100. FIG. 8B shows a sole structure 100 during an initial contact phase of a gait cycle, whereby the heel region 24 of the sole structure 100 initially engages the ground reference plane $Pl_{ground}$. At the initial contact phase, the posterior cambered segment 196, or at least a portion thereof, is generally parallel with the ground reference plane $Pl_{ground}$. As the gait cycle advances to from the initial contact phase (FIG. 8B) to the loading response phase (FIG. 8C), the convexity of the posterior cambered segment 196 facilitates a gradual transition to the midfoot without imparting reactive bending forces along the bottom of the foot. In other words, the posterior cambered segment 196 complements the forward rolling motion of the sole structure 100. As the sole structure 100 transitions through the mid-stance from the loading response phase (FIG. 8C) to the terminal stance phase (FIG. 8D), the platform 178 is oriented generally parallel to the ground reference plane $Pl_{ground}$, whereby each of the anterior cambered segment 190 and the posterior cambered segment 196 extends towards the ground reference plane $Pl_{ground}$ and distributes or absorbs some of the forces imparted to the platform by the metatarsophalangeal (MTP) joint of the foot. Thus, the anterior arcuate segment 180 and the posterior arcuate segment 182 may function as biasing or damping elements at opposite ends of the plate 110. In the push-off phase (FIG. 8E), the convexity of the anterior cambered segment 190 allows the toe portion $\mathbf{20}_T$ to roll along the ground reference plane $Pl_{ground}$ toward the anterior end 12. Thus, the cambered segments 190, 196 cooperate with the platform 178 to provide improved energy dissipation while simultaneously accommodating both the beginning and end phases of the natural gait cycle.

With particular reference to FIGS. 17-21E, an article of footwear 10*a* having a sole structure 100*a* is provided. Given the substantial similarity in structure and function of the article of footwear 10*a* with respect to the article of footwear 10, like reference numerals are used hereinafter and in the drawings to identify like components while reference numerals containing letter extensions are used to identify those components that have been modified.

As with the sole structure 100, the sole structure 100*a* includes a cushioning arrangement 108*a* having a medial cushion or cushioning structure 210*a* and a lateral cushion or cushioning structure 212*a*. The medial cushioning structure 210*a* is disposed proximate to the medial side 16 of the sole structure 100*a* while the lateral cushioning structure 212*a* is disposed proximate to the lateral side 18 of the sole structure 100*a*. Each of the medial cushioning structure 210*a* and the lateral cushioning structure 212*a* includes an upper bladder and a lower bladder.

The cushioning arrangement 108*a* may include an upper bladder and a lower bladder that are each identical to the upper bladder 214 or the lower bladder 216 described above with respect to the cushioning arrangement 108. While the upper bladder and the lower bladder of the cushioning arrangement 108*a* may be identical to the upper bladder 214 or the lower bladder 216, the upper bladder and the lower bladder of the cushioning arrangement 108*a* will be described and shown as being identical to the lower bladder 216.

As described above, the cushioning arrangement 108 may include an upper bladder and a lower bladder having the same size and shape. This configuration is shown in FIGS. 17-21E, where the cushioning arrangement 108*a* is shown as including an upper bladder 216 that has the same size and shape as a lower bladder 216. In one example, an internal height of the upper bladder 216 and the lower bladder 216—as measured by a thickness of the tensile element 222*b*—is approximately 11 mm. When a thickness of the barrier layers 218 is added to the thickness of each bladder 216, a total stack height of the upper bladder 216 and the lower bladder 216—as measured between an external surface of an upper barrier layer 218 of the upper bladder 216 and an external surface of a lower barrier layer 218 of the lower bladder 216—is approximately 23.5 mm. As with the sole structure 100, the receptacle 134 may be sized such that the height $H_{134}$ of the receptacle 134 is substantially equal to the stack height (i.e., 23.5 mm) of the upper bladder 216 and the lower bladder 216.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A plate for a sole structure of an article of footwear, the plate comprising:

a platform extending from a first platform end to a second platform end spaced from the first platform end, the platform being substantially planar from the first platform end to the second platform end;

a first arcuate segment extending in a first direction from the first platform end to a first distal end; and a second arcuate segment extending in an opposite second direction from the second platform end to a second distal end, the second distal end being coplanar with the first distal end, the first platform end, and the second platform end.

2. The plate of claim 1, wherein the first arcuate segment and the second arcuate segment include different lengths.

3. The plate of claim 1, wherein the first arcuate segment includes a first cambered portion defining a first convex surface along a bottom side of the plate having a first radius of curvature.

4. The plate of claim 3, wherein the first arcuate segment includes a first transition portion connecting the first cambered portion and the platform.

5. The plate of claim 4, wherein the first transition portion curves in an opposite direction than the first cambered portion and is tangent with the platform and the first cambered portion.

6. The plate of claim 4, wherein the second arcuate segment includes a second cambered portion defining a second convex surface along the bottom side of the plate having a second radius of curvature.

7. The plate of claim 6, wherein the second radius of curvature is greater than the first radius of curvature.

8. The plate of claim 7, wherein the second arcuate segment includes a second transition portion connecting the second cambered portion and the platform.

9. The plate of claim 8, wherein the second transition portion curves in an opposite direction than the second cambered portion and is tangent with the platform and the second cambered portion.

10. A sole structure for an article of footwear, the sole structure comprising:

a cushioning element; and a plate embedded within the cushioning element and including a planar platform extending from a first platform end to a second platform end spaced from the first platform end, a first arcuate segment extending in a first direction from the first platform end to a first distal end, and a second arcuate segment extending in an opposite second direction from the second platform end to a second distal end, the second distal end being coplanar with the first distal end and the planar platform.

11. The sole structure of claim 10, further comprising a cushioning arrangement including one or more compressible elements disposed between the plate and the cushioning element.

12. The sole structure of claim 11, wherein each of the compressible elements includes a bladder having an upper barrier layer and a lower barrier layer enclosing a chamber.

13. The sole structure of claim 12, wherein each bladder includes a tensile member including a plurality of tensile strands each extending between the upper barrier layer and the lower barrier layer.

14. The sole structure of claim 13, wherein the tensile strands cooperate with the upper barrier layer and the lower barrier layer to provide each bladder with a substantially planar top side and a substantially planar bottom side.

15. The sole structure of claim 11, wherein the compressible elements include resilient polymeric materials.

16. The sole structure of claim 15, wherein the compressible elements include foam.

17. The sole structure of claim 11, wherein the cushioning arrangement includes a first cushioning structure disposed adjacent to a medial side of the sole structure and a second cushioning structure disposed adjacent to a lateral side of the sole structure.

18. The sole structure of claim 17, wherein at least one of the first cushioning structure and the second cushioning structure includes a first bladder adjacent to the plate and a second bladder disposed between the first bladder and the cushioning element.

19. The sole structure of claim 18, wherein the first bladder includes at least one of a different width and a different height than the second bladder.

* * * * *